US007717638B2

(12) United States Patent
Harris et al.

(10) Patent No.: US 7,717,638 B2
(45) Date of Patent: May 18, 2010

(54) REFILLABLE NOTEBOOK

(75) Inventors: Richard H. Harris, Beavercreek, OH (US); Edward P. Busam, Mason, OH (US); J. Michael Tims, Kettering, OH (US)

(73) Assignee: MeadWestvaco Corporation, Richmond, VA (US)

( * ) Notice: Subject to any disclaimer, the term of this patent is extended or adjusted under 35 U.S.C. 154(b) by 1113 days.

(21) Appl. No.: 11/356,551

(22) Filed: Feb. 17, 2006

(65) Prior Publication Data

US 2006/0202465 A1 Sep. 14, 2006

Related U.S. Application Data

(60) Provisional application No. 60/654,412, filed on Feb. 18, 2005.

(51) Int. Cl.
*B42F 13/02* (2006.01)
*B42F 13/10* (2006.01)

(52) U.S. Cl. ..... 402/19; 402/8; 402/13; 281/27.1

(58) Field of Classification Search ..... 402/19, 402/70, 73, 74, 75, 34, 35, 8, 7, 13–15, 18; 24/598.2, 16 PB; 281/21.1, 24, 27, 27.1–27.3, 281/28

See application file for complete search history.

(56) References Cited

U.S. PATENT DOCUMENTS 134,724 A 1/1873 Billow
212,061 A * 2/1879 Smith ..... 402/70
267,890 A 11/1882 Herzberg
351,691 A 10/1886 Crosby (Continued)

FOREIGN PATENT DOCUMENTS

DE 1436185 10/1968

(Continued)

OTHER PUBLICATIONS

PerforMore® Flat Panel Binder (color photographs) (date unknown)
Applicants admit the status of this reference as prior art for the limited purpose of examination of this application, but otherwise reserve the right to challenge the status of the same as prior art.

(Continued)

*Primary Examiner*—Dana Ross
*Assistant Examiner*—Pradeep C Battula
(74) *Attorney, Agent, or Firm*—Alison R. Scheidler; Donald G. Bauer

(57) ABSTRACT

A binding mechanism assembly for binding a sheet item, the binding mechanism assembly including a backing member having an upper surface, and a binding member directly or indirectly coupled to the backing member. The binding member includes a protrusion shaped and located to protrude through a hole of a sheet item to be bound thereto. The binding member further includes a generally flexible flange that is manually movable into engagement with the protrusion to form a generally closed loop and thereby bind the sheet item thereto. The loop is rotatable relative to the backing member from a first position in which the loop is generally located above the upper surface to a second position wherein at least part of the loop is located below the upper surface. The loop is fixedly and not slidably coupled to the backing member.

38 Claims, 19 Drawing Sheets

U.S. PATENT DOCUMENTS

| | | | | | |
|---|---|---|---|---|---|
| 364,418 | A | | 6/1887 | Jayne | |
| 493,024 | A | | 3/1893 | Gottwals | |
| 509,972 | A | | 12/1893 | Tiffany et al. | |
| 534,260 | A | | 2/1895 | Gottwals | |
| 544,231 | A | | 8/1895 | Krah | |
| 656,568 | A | | 8/1900 | Noble | |
| 659,860 | A | * | 10/1900 | Schild | 402/20 |
| 683,019 | A | | 9/1901 | Buchanan | |
| 736,343 | A | | 8/1903 | Akass | |
| 754,791 | A | | 3/1904 | Mentzer | |
| 818,605 | A | | 4/1906 | Bollenbach | |
| 861,198 | A | | 7/1907 | Taylor | |
| 911,396 | A | | 2/1909 | Herdegen | |
| 1,048,852 | A | | 12/1912 | Morden | |
| 1,078,116 | A | | 11/1913 | Wolf | |
| 1,257,982 | A | | 3/1918 | Daugherty | |
| 1,261,523 | A | | 4/1918 | Harter | |
| 1,274,827 | A | | 8/1918 | Whitlock | |
| 1,513,518 | A | | 10/1924 | Pott | |
| 1,537,502 | A | | 5/1925 | Sellew | |
| 1,617,780 | A | | 2/1927 | Whitehouse et al. | |
| 1,618,842 | A | | 2/1927 | Von Der Marwitz | |
| 1,673,842 | A | | 6/1928 | Netter, Sr. | |
| 1,816,021 | A | | 7/1931 | Meyerson | |
| 1,982,409 | A | | 11/1934 | Adams | |
| 2,042,366 | A | | 5/1936 | Swank | |
| 2,063,548 | A | | 12/1936 | Greer | |
| 2,099,472 | A | | 11/1937 | Emery | |
| 2,099,881 | A | | 11/1937 | Emmer | |
| 2,133,069 | A | | 10/1938 | Williamson | |
| 2,251,343 | A | | 8/1941 | Spinner | |
| 2,265,822 | A | | 12/1941 | Spalding | |
| 2,329,786 | A | | 9/1943 | Ringler | |
| 2,363,848 | A | | 11/1944 | Emmer | |
| 2,364,859 | A | | 12/1944 | Lichtenstein | |
| 2,371,474 | A | | 3/1945 | Seelman | |
| 2,399,561 | A | | 4/1946 | Murphy | |
| 2,451,122 | A | | 10/1948 | Sherwood | |
| 2,468,355 | A | | 4/1949 | Ambler | |
| 2,559,556 | A | | 7/1951 | Ambler | |
| 2,572,305 | A | | 10/1951 | Bloore | |
| 2,575,583 | A | | 11/1951 | Clarke et al. | |
| 2,832,348 | A | | 4/1958 | Demarest, Jr. | |
| 2,911,977 | A | | 11/1959 | French | |
| 3,008,470 | A | | 11/1961 | Rubinstein | |
| 3,057,357 | A | | 10/1962 | Duncan | |
| 3,083,714 | A | | 4/1963 | Foster | |
| 3,087,498 | A | | 4/1963 | Vogel | |
| 3,197,830 | A | | 8/1965 | Hoadley | |
| 3,205,897 | A | | 9/1965 | Jamison | |
| 3,221,751 | A | | 12/1965 | Brandon | |
| 3,236,242 | A | | 2/1966 | Galiley | |
| 3,246,653 | A | * | 4/1966 | Sexton | 402/15 |
| 3,251,364 | A | | 5/1966 | Goldman | |
| 3,260,264 | A | | 7/1966 | McKowen | |
| 3,262,454 | A | | 7/1966 | Shillinger | |
| 3,263,687 | A | * | 8/1966 | Weichert | 402/39 |
| 3,270,749 | A | | 9/1966 | O'Connell | |
| 3,313,303 | A | | 4/1967 | Beyer | |
| 3,313,304 | A | | 4/1967 | Beyer | |
| 3,315,682 | A | | 4/1967 | Bachman | |
| 3,331,373 | A | * | 7/1967 | Lohmeier | 402/8 |
| 3,362,411 | A | | 1/1968 | Moller | |
| 3,362,412 | A | | 1/1968 | Moller | |
| 3,383,786 | A | | 5/1968 | McIntosh | |
| 3,516,755 | A | | 6/1970 | Smith | |
| 3,529,900 | A | | 9/1970 | Pettit | |
| 3,612,709 | A | | 10/1971 | Miyamoto | |
| 3,748,051 | A | | 7/1973 | Frank | |
| 3,762,823 | A | | 10/1973 | Gregson | |
| 3,785,740 | A | | 1/1974 | Strong | |
| 3,834,824 | A | | 9/1974 | Jahn | |
| 3,850,488 | A | | 11/1974 | Elias et al. | |
| 3,927,949 | A | | 12/1975 | Clinch | |
| 3,950,107 | A | * | 4/1976 | Seaborn | 402/22 |
| 3,954,343 | A | | 5/1976 | Thomsen | |
| 3,970,331 | A | | 7/1976 | Giulie | |
| 4,000,951 | A | | 1/1977 | Agnew et al. | |
| 4,120,517 | A | | 10/1978 | Staats | |
| 4,135,832 | A | * | 1/1979 | Saltz | 402/15 |
| 4,172,675 | A | | 10/1979 | Lacourt | |
| 4,174,909 | A | | 11/1979 | Jahn | |
| 4,192,620 | A | * | 3/1980 | Jahn | 402/15 |
| 4,200,404 | A | | 4/1980 | Agnew et al. | |
| 4,256,411 | A | | 3/1981 | Podosek | |
| 4,261,664 | A | | 4/1981 | Crawford | |
| 4,269,530 | A | * | 5/1981 | Weber | 402/15 |
| 4,294,558 | A | | 10/1981 | Errichiello | |
| 4,295,747 | A | | 10/1981 | Errichiello | |
| 4,304,499 | A | | 12/1981 | Porcocks | |
| 4,307,972 | A | | 12/1981 | Errichiello | |
| 4,340,316 | A | | 7/1982 | Jahn | |
| 4,371,194 | A | | 2/1983 | Wang et al. | |
| 4,375,925 | A | | 3/1983 | Grummich | |
| 4,397,577 | A | | 8/1983 | Bauer | |
| 4,405,250 | A | | 9/1983 | Wu | |
| 4,415,290 | A | | 11/1983 | Ohminato | |
| 4,437,781 | A | | 3/1984 | Weihe et al. | |
| 4,445,799 | A | | 5/1984 | Wright et al. | |
| 4,453,850 | A | | 6/1984 | Purcocks | |
| 4,453,851 | A | | 6/1984 | Purcocks | |
| 4,484,830 | A | | 11/1984 | Anderson | |
| 4,511,161 | A | | 4/1985 | Gruner | |
| 4,518,275 | A | | 5/1985 | Rauch, III et al. | |
| 4,577,985 | A | | 3/1986 | Beyer | |
| 4,607,970 | A | | 8/1986 | Heusinkveld | |
| 4,693,624 | A | * | 9/1987 | Moosmuller | 402/22 |
| 4,761,091 | A | | 8/1988 | Ominato et al. | |
| 4,765,768 | A | | 8/1988 | Wright | |
| 4,775,257 | A | | 10/1988 | Eigg | |
| 4,784,507 | A | | 11/1988 | Vetter | |
| 4,869,613 | A | | 9/1989 | Corey | |
| 4,932,804 | A | | 6/1990 | Richards | |
| 4,941,804 | A | | 7/1990 | Sarpy, Jr. | |
| 4,973,184 | A | | 11/1990 | La Salle | |
| 5,018,895 | A | | 5/1991 | Meier, Jr. | |
| 5,037,228 | A | | 8/1991 | Karlin | |
| 5,110,232 | A | | 5/1992 | Jermann | |
| 5,138,855 | A | | 8/1992 | Faris | |
| 5,154,528 | A | | 10/1992 | Cananzey et al. | |
| 5,160,209 | A | | 11/1992 | Schuessler | |
| 5,163,768 | A | | 11/1992 | Salisbury et al. | |
| 5,167,463 | A | * | 12/1992 | Corbishley | 402/8 |
| 5,180,247 | A | | 1/1993 | Yu | |
| 5,238,270 | A | | 8/1993 | Ozeki | |
| 5,286,128 | A | | 2/1994 | Gillum | |
| 5,332,327 | A | | 7/1994 | Gillum | |
| 5,333,962 | A | | 8/1994 | Johnson | |
| 5,338,125 | A | | 8/1994 | Forsse et al. | |
| 5,339,546 | A | | 8/1994 | Rahwan | |
| 5,377,825 | A | | 1/1995 | Sykes et al. | |
| 5,393,156 | A | | 2/1995 | Mullin et al. | |
| 5,405,209 | A | | 4/1995 | Johns et al. | |
| 5,423,624 | A | * | 6/1995 | Richards | 402/13 |
| 5,593,242 | A | | 1/1997 | Mathias | |
| 5,611,633 | A | | 3/1997 | Whaley | |
| 5,618,122 | A | | 4/1997 | Constantine | |
| 5,642,954 | A | | 7/1997 | Hudspith | |
| 5,667,323 | A | | 9/1997 | Whaley | |
| 5,683,193 | A | | 11/1997 | Cerri | |
| 5,692,848 | A | | 12/1997 | Wada | |
| 5,697,721 | A | | 12/1997 | von Rohrscheidt | |
| 5,697,722 | A | | 12/1997 | Hladik et al. | |
| 5,718,530 | A | | 2/1998 | Tibbetts | |

| | | | | |
|---|---|---|---|---|
| 5,720,564 | A | 2/1998 | Winzen | |
| 5,725,251 | A | 3/1998 | Heggeland | |
| 5,882,135 | A | 3/1999 | Ko | |
| 5,964,544 | A | 10/1999 | Ko | |
| 5,988,685 | A | 11/1999 | Mogelonsky et al. | |
| 5,988,926 | A | 11/1999 | Kiyomi | |
| 6,000,873 | A | 12/1999 | Burton | |
| 6,062,760 | A | 5/2000 | Whaley | |
| 6,099,187 | A | 8/2000 | Youngs | |
| 6,129,316 | A | 10/2000 | Bauer | |
| 6,168,337 | B1 | 1/2001 | Adams | |
| 6,168,338 | B1 * | 1/2001 | Young | 402/26 |
| 6,200,057 | B1 | 3/2001 | Youngs et al. | |
| 6,250,816 | B1 | 6/2001 | Johnston et al. | |
| 6,250,834 | B1 | 6/2001 | Wien | |
| 6,328,497 | B1 | 12/2001 | To | |
| 6,381,393 | B1 | 4/2002 | Matthews et al. | |
| 6,386,784 | B1 | 5/2002 | Ruble | |
| 6,435,753 | B1 | 8/2002 | Gusack | |
| 6,505,987 | B1 | 1/2003 | Turner, III et al. | |
| 6,514,000 | B2 | 2/2003 | Youngs et al. | |
| 6,966,721 | B2 * | 11/2005 | Sato et al. | 402/73 |
| 2001/0051069 | A1 * | 12/2001 | Youngs et al. | 402/73 |
| 2004/0037614 | A1 | 2/2004 | Busam et al. | |

FOREIGN PATENT DOCUMENTS

| | | | |
|---|---|---|---|
| DE | 6914733 | | 10/1969 |
| DE | 7223755 | | 11/1972 |
| DE | 7527298 | | 3/1976 |
| DE | 7630776 | | 1/1977 |
| DE | 2612625 | | 9/1977 |
| DE | 3232986 | | 11/1983 |
| DE | 3511304 | | 10/1986 |
| DE | 8702107 | | 4/1987 |
| DE | 3708432 | | 9/1988 |
| DE | 29712982 | | 11/1997 |
| DE | 19632199 | | 2/1998 |
| DE | 19930035 | | 1/2001 |
| EP | 0258464 | | 8/1986 |
| EP | 0559444 | | 9/1993 |
| FR | 817170 | | 8/1937 |
| FR | 1364099 | | 6/1964 |
| FR | 2505262 | | 11/1982 |
| FR | 2592838 | | 7/1987 |
| FR | 2614841 | | 11/1988 |
| FR | 2614841 | A1 * | 11/1988 |
| FR | 2650538 | | 2/1991 |
| GB | 948465 | | 2/1964 |
| GB | 968650 | | 9/1964 |
| GB | 1209770 | | 10/1970 |
| GB | 2213432 | | 8/1989 |
| GB | 2232639 | | 12/1990 |
| JP | A-S48-030523 | | 4/1973 |
| JP | A-S51-005126 | | 1/1976 |
| JP | A-S56-113498 | | 9/1981 |
| JP | U-S57-050377 | | 3/1982 |
| JP | U-S58-050969 | | 4/1983 |
| JP | U-S58-050970 | | 4/1983 |
| JP | A-S61-100498 | | 5/1986 |
| JP | U-S61-100581 | | 6/1986 |
| JP | A-S61-189998 | | 8/1986 |
| JP | U-S63-060675 | | 4/1988 |
| JP | A-H03-266698 | | 11/1991 |
| JP | A-H04-153098 | | 5/1992 |
| JP | U-H04-098187 | | 8/1992 |
| JP | U-H06-007979 | | 2/1994 |
| JP | U-H06-034982 | | 5/1994 |
| JP | A-H07-096695 | | 4/1995 |
| JP | A-H09-095078 | | 4/1997 |
| JP | A-H09-240184 | | 9/1997 |
| JP | 3049083 | | 3/1998 |
| JP | A-H10-058881 | | 3/1998 |
| JP | A-H10-100577 | | 4/1998 |
| JP | A-H10-166775 | | 6/1998 |
| JP | A-H11-048673 | | 2/1999 |
| JP | A-H11-139064 | | 5/1999 |
| WO | 90/09894 | | 9/1990 |
| WO | 96/22888 | | 8/1996 |

OTHER PUBLICATIONS

Lion "Slim & Beauty" SB File (color photographs) (Sep. 2004).

Kokuyo Product (black and white photographs) (date unknown) Applicants admit the status of this reference as prior art for the limited purpose of examination of this application, but otherwise reserve the right to challenge the status of the same as prior art.

Cable Connectors (color photographs from web page) (date unknown) Applicants admit the status of this reference as prior art for the limited purpose of examination of this application, but otherwise reserve the right to challenge the status of the same as prior art.

Binder Photographs (color photographs from web page) (date unknown) Applicants admit the status of this reference as prior art for the limited purpose of examination of this application, but otherwise reserve the right to challenge the status of the same as prior art.

Cable Connectors and Binder (color photographs from web page) (date unknown) Applicants admit the status of this reference as prior art for the limited purpose of examination of this application, but otherwise reserve the right to challenge the status of the same as prior art.

* cited by examiner

REFILLABLE NOTEBOOK

This application claims priority to U.S. Provisional Patent Application No. 60/654,412, filed on Feb. 18, 2005, the entire contents of which are hereby incorporated by reference.

The present invention is directed to a notebook, and more particularly, to a notebook in which sheet items and other contents can be added to or removed from the notebook.

BACKGROUND

Many notebooks, such as spiral bound or coil bound notebooks, include a set of papers, and optionally covers, which are bound together by the spiral or coil binding mechanism. The spiral or coil binding mechanism may allow the various sheets of the notebook to be folded three hundred and sixty degrees or nearly three hundred and sixty degrees around the binding mechanism such that the folded sheets can underlie the unfolded sheets lying thereabove.

However, in most spiral bound or coil bound notebooks, papers cannot be removed from the notebook without tearing the papers. In addition, such spiral bound and coil bound notebooks do not easily allow a user to add papers thereto. Accordingly, there is a need for a notebook having a binding mechanism which allows sheets and other contents to be pivoted underneath overlying sheets, and which allows the sheets and other contents to be easily removed from, and added to, the notebook.

SUMMARY

In one embodiment, the invention is a binding mechanism assembly for binding a sheet item. The binding mechanism assembly includes a backing member having an upper surface, and a binding member directly or indirectly coupled to the backing member. The binding member includes a protrusion shaped and located to protrude through a hole of a sheet item to be bound thereto. The binding member further includes a generally flexible flange that is manually movable into engagement with the protrusion to form a generally closed loop and thereby bind the sheet item thereto. The loop is rotatable relative to the backing member from a first position in which the loop is generally located above the upper surface to a second position wherein at least part of the loop is located below the upper surface. The loop is fixedly and not slidably coupled to the backing member.

In another embodiment the invention is a binding mechanism assembly for binding a plurality of sheet items. The binding mechanism assembly includes a generally flat, planar backing member configured to generally fully support 8½ inch by 11 inch paper or A4 size paper thereon. The binding mechanism assembly further includes at least two binding members directly or indirectly coupled to the backing member. Each binding member includes a protrusion shaped and located to protrude through a hole of a plurality of sheet items to be bound thereto. Each binding member further includes a flange configured to engage the associated protrusion to form a generally closed loop and thereby bind the plurality of sheet items thereto. Each binding member is independently pivotable relative to the backing member. Selected ones of the plurality of sheet items bound to the binding member are pivotable about the closed loops to a position wherein the pivoted sheet items are located below the backing member and the remainder of the plurality of sheet items are in a generally flat configuration and located above the backing member. The plurality of sheet items located below the backing member are in a generally flat configuration and are oriented generally parallel with the plurality of sheet items located above the backing member.

In another embodiment the invention is a method for manipulating a binding mechanism assembly. The method includes the step of providing a binding mechanism assembly including a generally flat, planar backing member having an inner edge and a binding member coupled to the backing member. The binding member includes a protrusion and a flange, and the binding member is generally located above the backing member. The method further includes coupling a plurality of sheet items, each sheet item having a hole, to the binding mechanism assembly such that the protrusion extends through the hole of each sheet item. The method further includes manually causing the flange to engage the protrusion to form a generally closed loop and thereby bind the sheet items therein. The method includes the step of causing the generally closed loop to pivot about a pivot axis in a first direction relative to the backing member such that at least part of the generally closed loop is located below the backing member while the backing member remains in a generally flat, planar condition. The pivot axis is spaced away from the inner edge.

DETAILED DESCRIPTION

Figure 1:
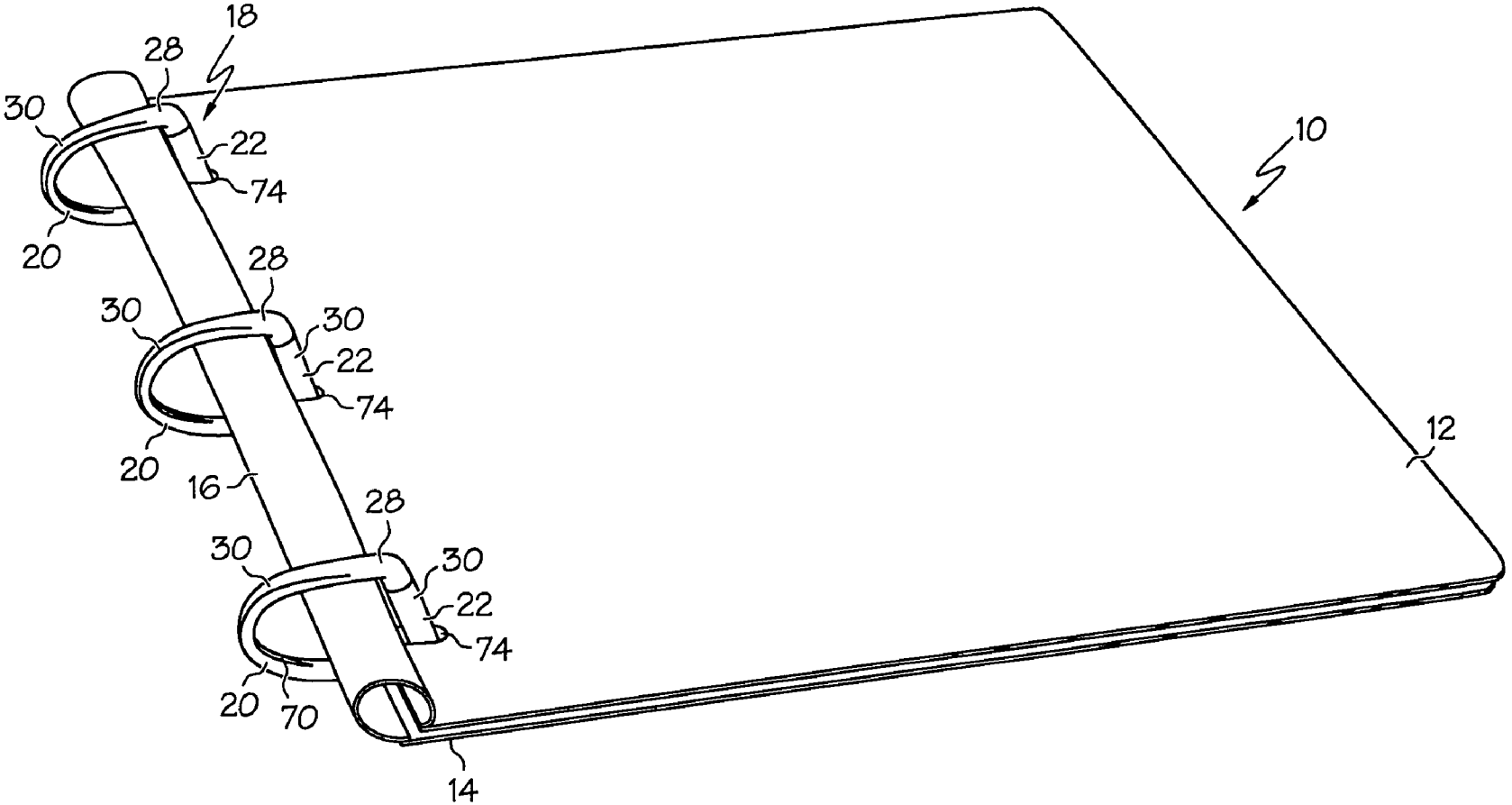
FIG. 1 is a front perspective view of one embodiment of the notebook of the present invention, with the front cover closed and the binding mechanisms shown in their closed position.
Figure 2:
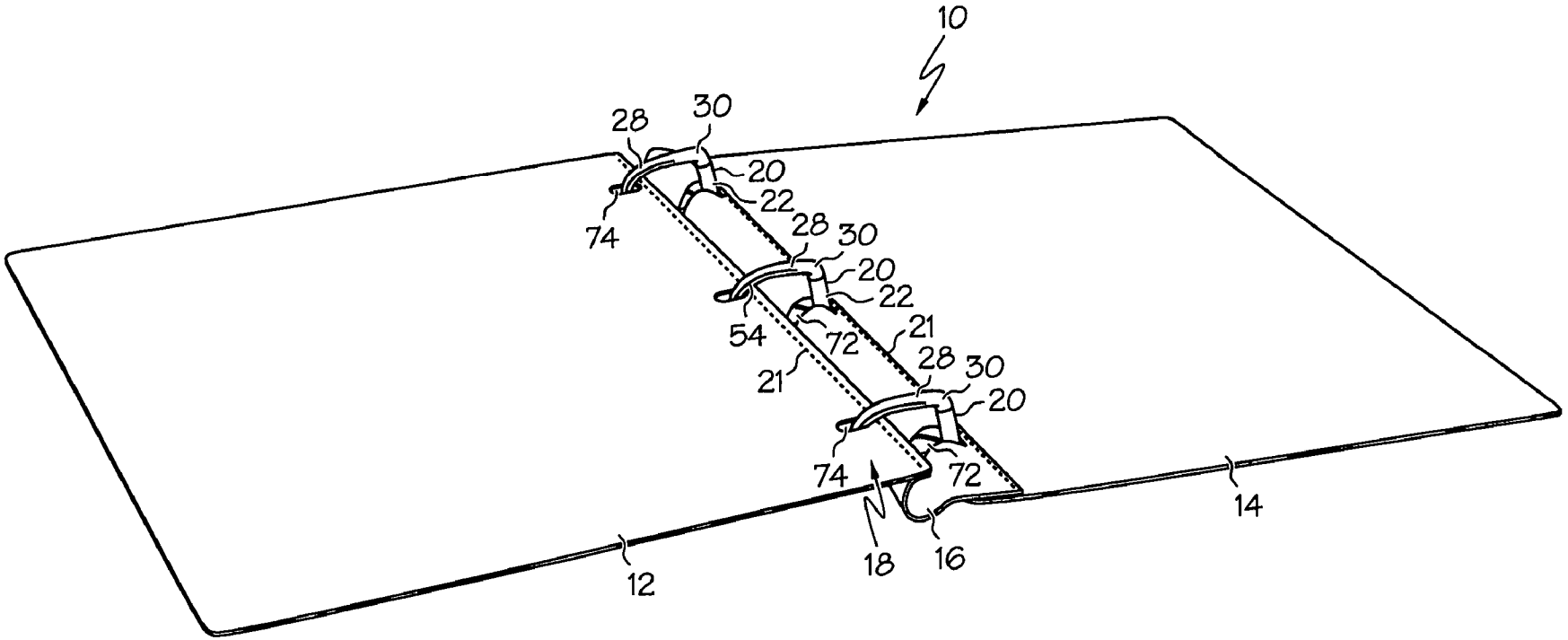
FIG. 2 is a front perspective view of the notebook of FIG. 1, with the front cover pivoted away from the closed position.
Figure 3:
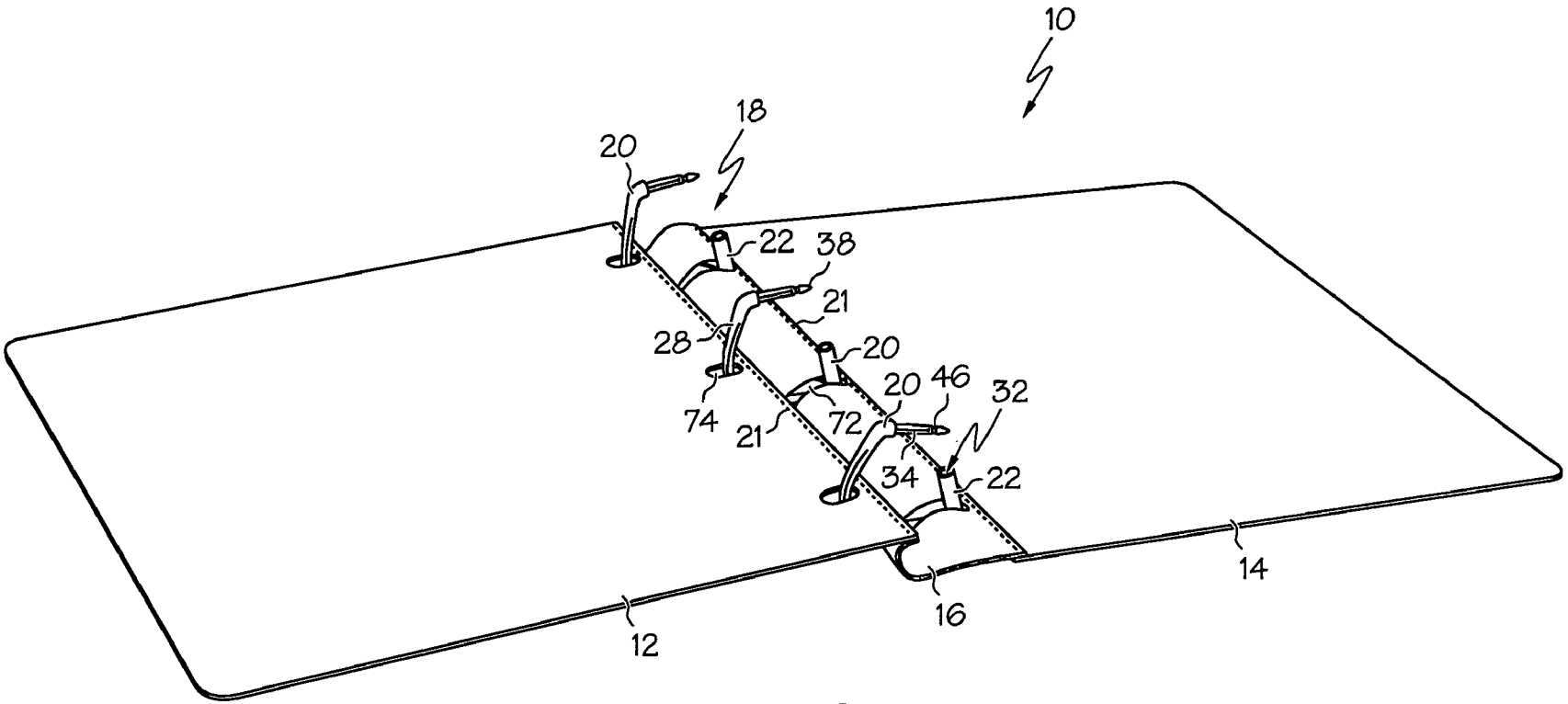
FIG. 3 is a front perspective view of the notebook of FIG. 2, with the binding mechanisms in their open positions.

As best shown in FIGS. 1-3, in one embodiment the present invention is a notebook 10 having a front cover 12, a rear cover or backing panel 14, and a spine guard 16 coupled to the front cover 12 and rear cover 14. Each of the front 12 and rear 14 covers may be a generally flat, stiff planar sheet-like member having a flat upper surface, and can be made of a variety of materials, including plastic, cardboard, paperboard, combinations of these materials and the like. The front 12 and rear covers 14 may have a variety of thicknesses, such as between about 0.01 inches and about 0.5 inches, and in one case are each about 0.08 inches thick.

The front 12 and rear 14 covers may have a variety of shapes and dimensions. For example, each of the front 12 and rear 14 covers may have a width (i.e., extending perpendicular to the spine guard 16) of between about eight and about twelve inches, and a height (extending generally parallel to the spine guard 16) of between about eleven and one-half and about fourteen inches. Thus, front and rear covers 12, 14 may be sufficiently sized to generally fully support and closely receive eight and one-half inch by eleven inch sheets of paper thereon. However, the front 12 and rear 14 covers can have various other sizes and may be sized to generally correspond to and support various other papers and components (i.e., index cards, legal size paper, A4 size paper, etc.) thereon.

In the illustrated embodiment the notebook 10 includes the spine guard 16 which may be a generally rectangular piece of material that is made of a relatively thin, flexible material, such as plastic, woven plastic, woven fabric or the like. The spine guard 16 may be more flexible and/or thinner than the front 12 or rear 14 covers. The notebook 10 may lack a generally rigid spine (i.e., in one case a spine having at least about the same stiffness and/or thickness as the front 12 and/or rear 14 covers). The spine guard 16 can be coupled to the front cover 12 and rear cover 14 by a variety of means, including stitching (i.e., see stitching 21 shown in FIGS. 2-6), adhesives, molding, heat welding, sonic welding or the like. In the illustrated embodiment, the spine guard 16 is generally rectangular (when laid flat) and has a pair of longitudinal edges, wherein each longitudinal edge is coupled to the one of the front cover 12 or rear cover 14 by stitching.

Figure 4:
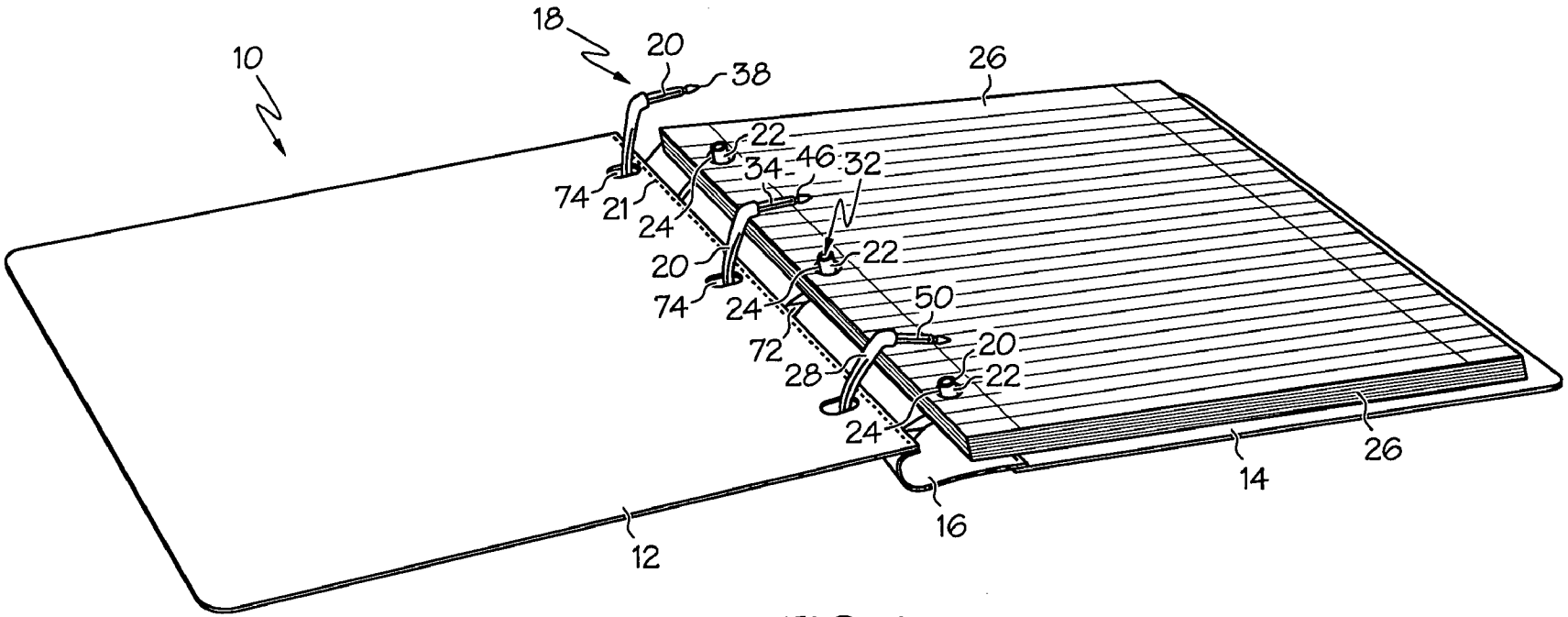
FIG. 4 is a front perspective view of the notebook of FIG. 3, with a plurality of papers added therein.

The notebook 10 includes a binding mechanism assembly 18, with the binding mechanism assembly 18 including a plurality of individual binding mechanisms or binding members 20. Each binding mechanism 20 may include a protrusion 22 that is shaped and located to fit through the hole 24 of a sheet item 26, as shown in FIG. 4. Each protrusion 22 may extend generally perpendicular to the rear cover 14 when no papers, sheet items 26 or components are located on the rear cover 14. Alternately each protrusion 22 may extend at a slight angle, such as a rearward angle wherein each protrusion 22 angles back towards the spine of the notebook 10, as best shown in FIG. 1.

Once a flange 28 is coupled to the protrusion 22, the flange 28 and protrusion 22 formed a closed loop 30. The length of the protrusion 22 and/or flange 28 can be adjusted to provide loops 30 with varying storage capacities. For example, relatively long protrusions 22 and flanges 28 may be utilized to provide relatively large loops 30 for a relatively high capacity notebook, and relatively short protrusions 22 and flanges 28 may be utilized to provide relatively small loops 30 for a relatively low profile, low capacity notebook.

Each binding mechanism 20 may further include a flange 28 which is movable or flexible to move between a closed position as shown in, for example, FIGS. 1 and 2 (wherein each flange 28 engages and/or is coupled to the associated protrusion 22) and an open position as shown in, for example, FIG. 3 (wherein each flange 28 is spaced away from the associated protrusion 22). When a flange 28 is coupled to an associated protrusion 22, each flange/protrusion combination forms a generally closed loop 30 to thereby bind any sheet item 26 on the protrusions 22 to the notebook 10. Each binding mechanism 20 may be individually or independently operable (i.e., each binding mechanism 20 is independently or individually movable between the closed and open positions).

Figure 10:
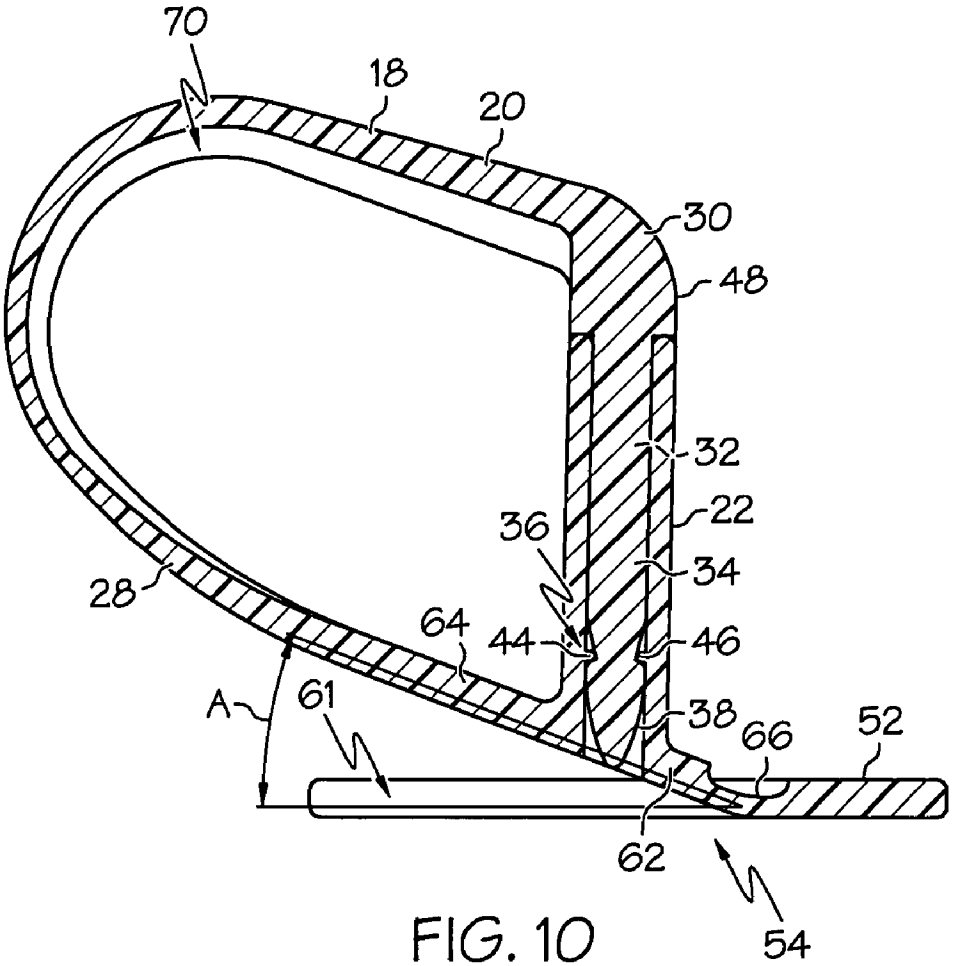
FIG. 10 is a side cross section of one of the binding mechanisms of the notebook of FIG. 1.

As best shown in FIG. 10, each protrusion 22 may be a hollow generally cylindrical member having a generally cylindrical cavity 32 formed therein. Each flange 28 may terminate in a generally cylindrical projection 34 sized and shaped to be closely received in the cavity 32 of the protrusion 22 to form the closed loop 30. Each projection 34 may include a tapered end surface 38, although the end surface 38 need not necessarily be tapered. The base of the projection 34 may have a generally rounded outer corner 48 (see FIG. 10) to prevent sheet items 26 from being caught on the outer corner 48 as the sheet items 26 are pivoted around the closed loops 30.

Each binding mechanism 20 may include a coupling assembly or locking arrangement, generally designated 36, for attaching or coupling each flange 28 to an associated protrusion 22 (and more particularly, for securing each projection 34 within an associated cavity 32). In the illustrated embodiment, the lower end of each cavity 32 includes an annular or ring-like lip, bump or locking member 44 located therein. Each projection 34 includes an annular or circumferential recess or groove 46 shaped to receive the locking member 44 therein.

In order to couple a flange 28 to an associated protrusion 22, the projection 34 of the flange 28 is inserted into the cavity 32 of the protrusion 22 until the tapered end surface 38 of the projection 34 engages the locking member 44. As the flange 28 is urged deeper into the protrusion 22, the distal end of the projection 34 may be deflected or compressed radially inwardly. If desired, the flange 28/projection 34, or parts of the flange 28/projection 34, may be hollow (not shown) to allow the flange 28/projection 34 to be compressed radially inwardly. At the same time, the portions of protrusion 22 located adjacent to the locking member 44 may move radially outwardly or "bulge" outwardly to allow the projection 34 and tip 38 to fit therethrough. Once the projection 34 is inserted to a sufficient depth, the locking member 44 seats in the annular groove 46 to releasably couple the flange 28/projection 34 to the protrusion 22 (FIG. 10).

In order to uncouple the flange 28/projection 34 from the protrusion 22, the flange 28/projection 34 can be manually pulled upwardly until the locking member 44 is pulled out of the annular groove 46 to allow the flange 28/projection 34 to be lifted out of the protrusion 22/cavity 32. The size and shape of the annular groove 46 and locking member 44, as well as the thickness of the protrusion wall around the locking member 44 may be adjusted as desired so that the force required to lock and unlock the protrusion 22 and flange 28 is set to the desired level.

The coupling assembly 36 (which may include the locking member 44 and annular groove 46) may be shaped and/or configured such that a user can relatively easily manually couple and uncouple the protrusion 22 and flange 28, while providing a sufficiently strong connection that the protrusion 22 and flange 28 resist being uncoupled during normal usage. The tapered shape of the end surface 38 allows the projection 34 to be fully inserted into the cavity 32 relatively easily, yet resist withdrawal to prevent accidental opening of the closed loops 30. Although the protrusion 22, cavity 32 and projection 34 can have a variety of lengths, in one embodiment the protrusions 22, and/or cavity 32 and/or projection 34 each have a length of at least about 0.25 inches, or at least about 0.5 inches, or at least about 1 inch to ensure that the flange 28 can be securely coupled to the protrusion 22.

Figure 11:
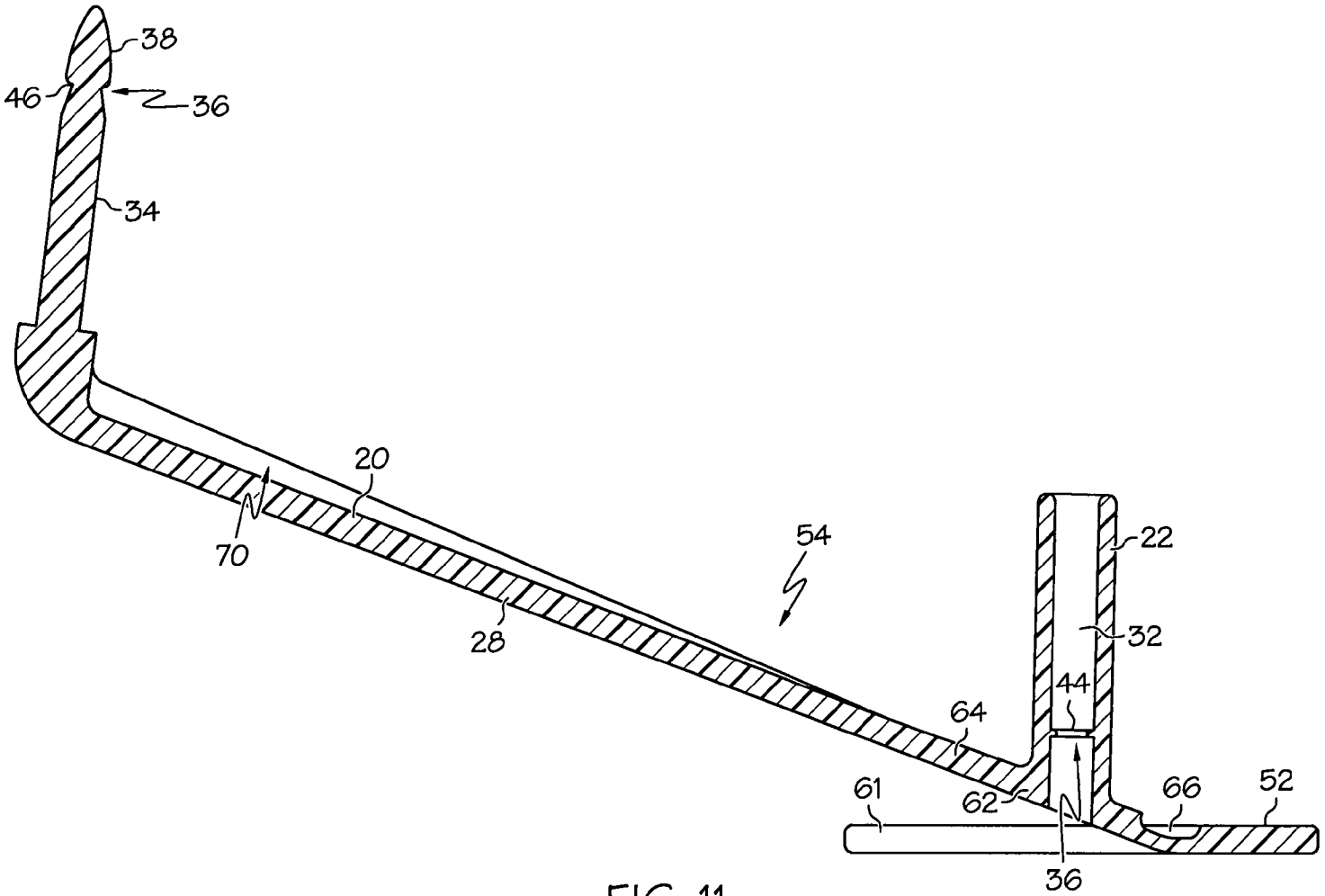
FIG. 11 is a side cross section of the binding mechanism of FIG. 10, shown in its open position.

The coupling assembly 36 can take any of a wide variety of shapes and forms beyond the annular groove 46/locking member 44 arrangement shown in FIGS. 10 and 11. For example, the positions of the locking member 44 and the annular groove 46 may be reversed such that the locking member 44 is located on the projection 34, and the annular groove 46 is located in the protrusion cavity 32. Furthermore, broadly speaking the position of the projection 34 and protrusion cavity 32 may be reversed. Thus, the protrusion 22 may be a cylinder to form the male projection 34 and the flange 28 may include a hollow member defining the female cavity 32 at its distal end. In addition, any of a wide variety of snaps, interengaging and interlocking geometries, interference fits and the like may be utilized as the coupling assembly 36.

In the illustrated embodiment, each projection 34 is generally cylindrical and the cavity 32 of each protrusion 22 is also generally cylindrical to closely receive the projection 34 therein. However, if desired the projections 34/cavity 32 can have any of variety of other shapes in cross section, such as square, hexagon, oval, triangular, etc. The use of eccentric or noncircular cross sectional shapes may be used to rotationally couple the projections 34 and associated cavity 32. If desired, each projection 34 may include longitudinally or axially extending grooves 50 (see FIG. 15) formed therein to provide materials savings, improve molding conditions, or improve structural characteristics of the projection 34.

Figure 8:
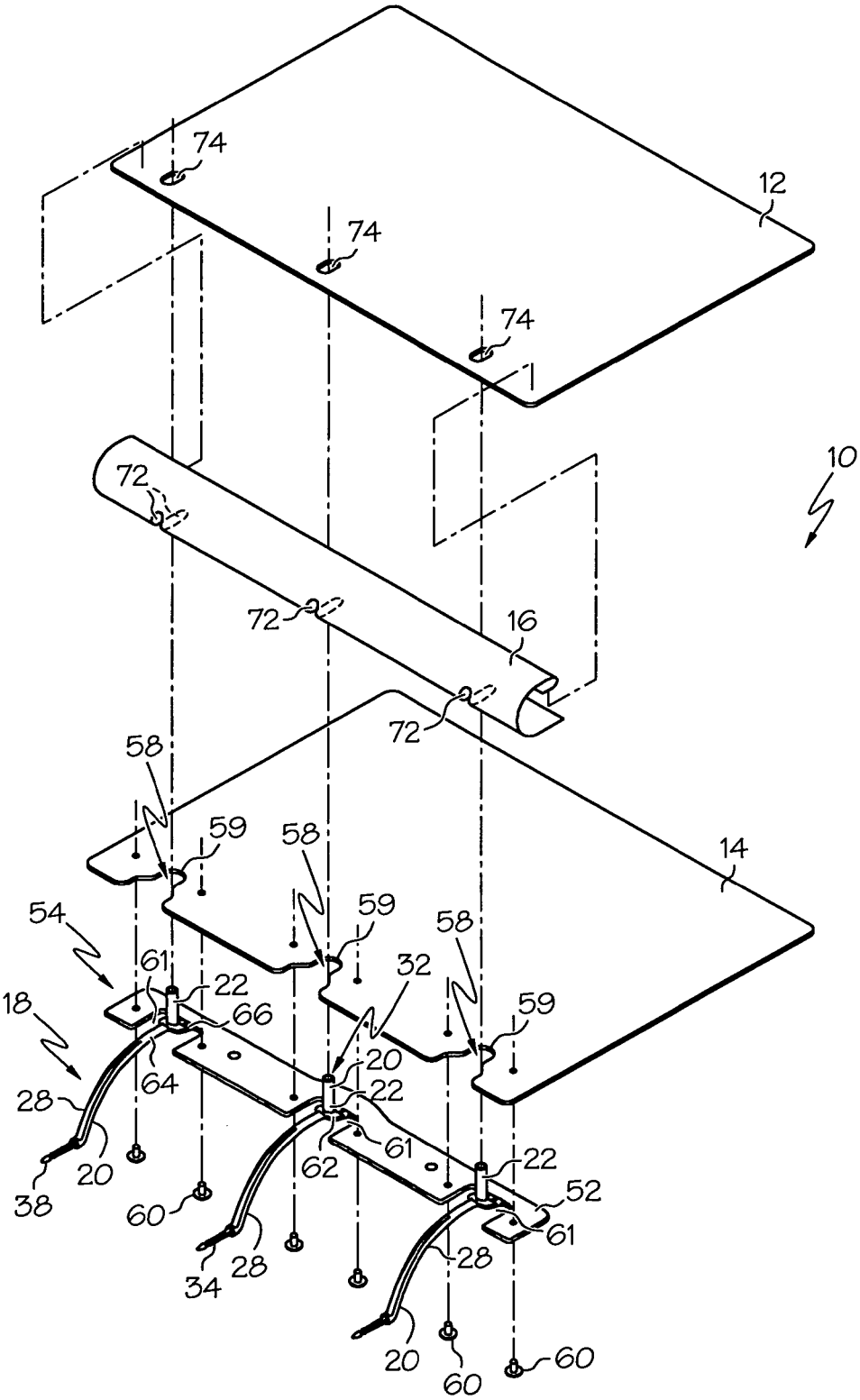
FIG. 8 is an exploded perspective view of the notebook of FIG. 1, with the binding mechanisms in their open positions.

As best shown in FIG. 8, each binding mechanism 20 may be located on or coupled to a generally flat support surface 52 having a flat upper surface, with one or more binding mechanisms 20 coupled to and/or extending from the support surface 52 to form a binding portion or backing member 54. Each binding mechanism 20 may be directly coupled to the support surface 52; i.e. in a non-binding manner wherein the support surface 52 does not receive the loops 30 therethrough. The support surface 52/binding portion 54 may have a width of between about ¾ inches and about 2 inches. In the illustrated embodiment the binding portion 54 is coupled to the underside of the rear cover 14 by a set of rivets 60. However, a wide variety of methods for coupling the binding portion 54 to the rear cover 14 may be utilized, including but not limited to, adhesives, welding, use of plastic or metal rivets, various interference fits, heat welding, sonic welding and the like. In one embodiment, the binding portion 54 is directly coupled to the rear cover 14 by a line of stitching 63 (see FIG. 9) that extends generally the entire length of the binding portion 54, and through the rear cover 14 and binding portion 54. The stitching 63 helps to further secure the binding portion 54 to the rear cover 14 and ensures that an end of the binding portion 54 cannot be pried upwardly and away from the rear cover 14 (which could lead to de-coupling of the binding portion 54 and rear cover 14 should a component get wedged between the binding portion 54 and rear cover 14). The rear cover 14 may include a set of notches 58 formed along its inner edge to receive the protrusions 22 therein, with each notch 58 having an inner surface 59.

Figure 20:
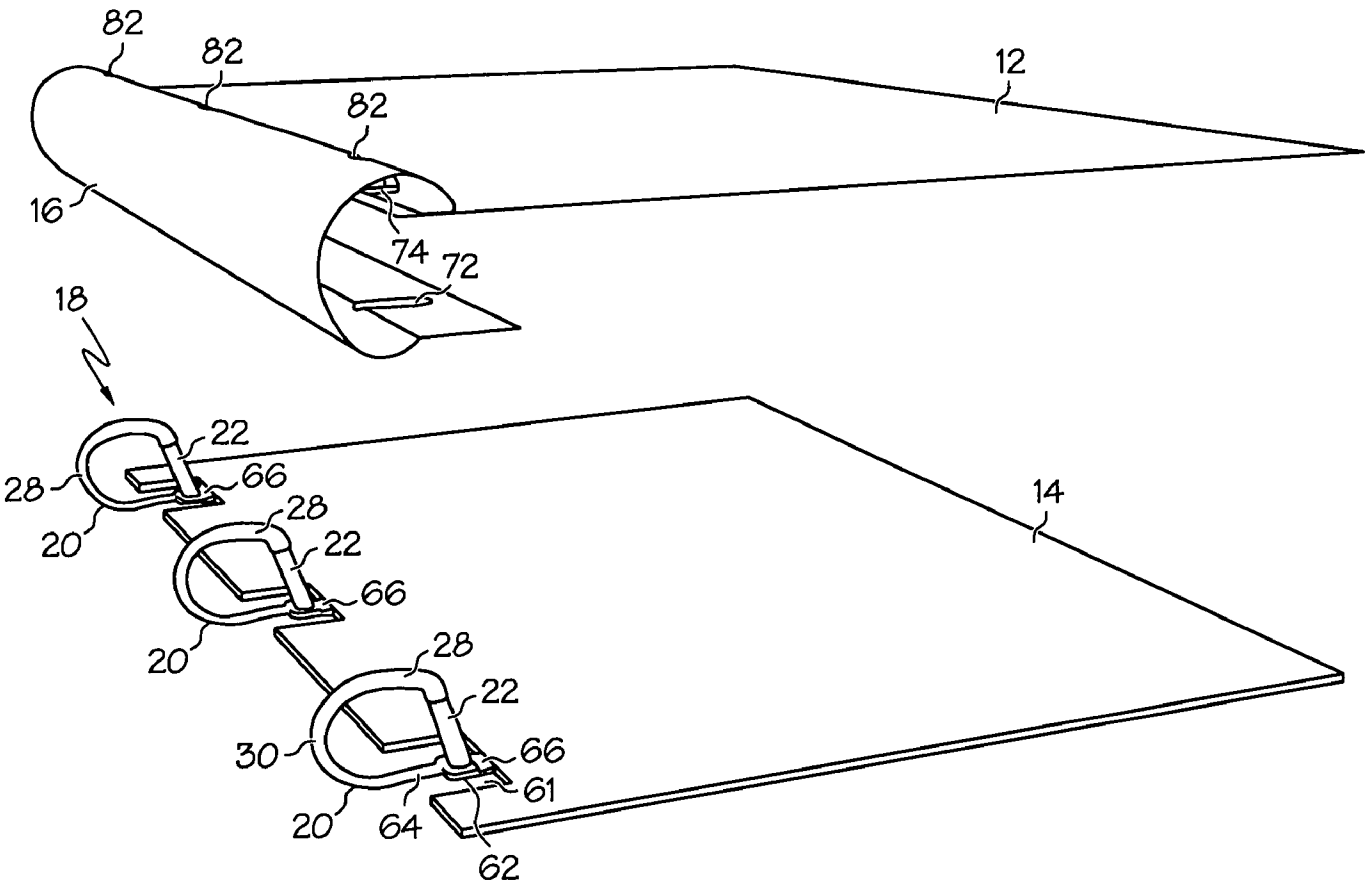
FIG. 20 is an exploded perspective view of another embodiment of the notebook of the present invention.

If desired, the binding portion 54 (i.e. the support surface 52, protrusions 22 and flanges 28) may be of a one-piece or monolithic piece of material. Thus, the binding portion 54 may be formed from a single, unitary piece of material, such as plastic or polymer that is molded in the desired shape. Making the binding portion 54 out of a plastic or polymer may also provide flanges 28 with the desired flexibility. In another embodiment, the protrusions 22, flanges 28 and rear cover 14 may be formed as a one-piece or monolithic piece of material, as shown in FIG. 20. In this case there is no separate binding portion 54 and accordingly there is no need for the rivets 60, or stitching 63 or other coupling mechanisms.

The embodiment of FIG. 8 (with a separate binding portion 54) may allow more efficient manufacturing because the rear panel 14 of that embodiment can be easily formed from flat, plastic sheets, or various other materials which can be cheaply made and easily cut to size. In contrast, in certain cases the embodiment of FIG. 20 may provide more efficient manufacturing since a manufacturing step (i.e., attaching the binding portion 54 to the rear cover 14) is eliminated.

Figure 14:
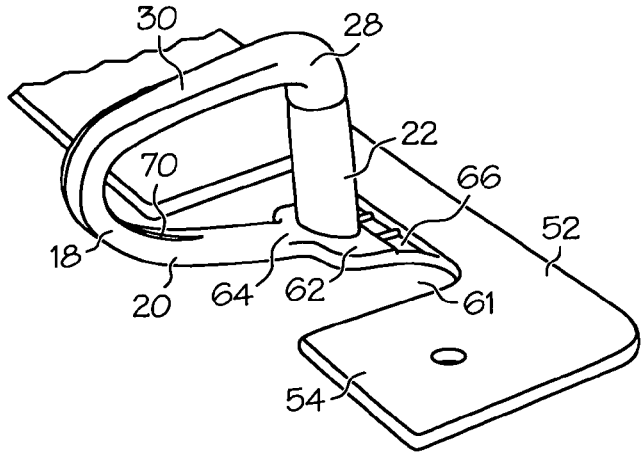
FIG. 14 is a detail perspective view of the binding mechanism of FIG. 10.
Figure 15:
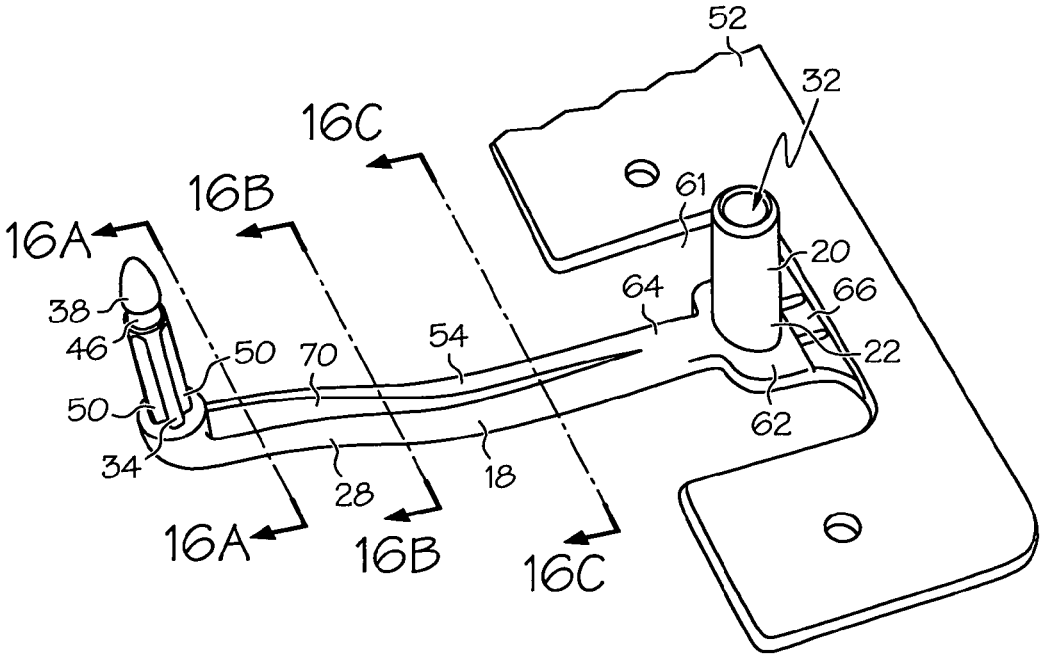
FIG. 15 is a detail perspective view of the binding mechanism of FIG. 14, shown in its open position.

As best shown in FIGS. 14 and 15, each protrusion 22 may be located on and extend generally upwardly from a generally flat support portion 62. If desired, each support portion 62 can be considered to be part of the associated flange 28 and/or protrusion 22, and each flange 28 may thus be directly coupled to the associated protrusion 22. Each associated flange 28 is also coupled to, and extends laterally from, the associated support portion 62 at its base/base portion/base end 64.

Each support portion 62 (and the associated protrusion 22/flange 28/binding mechanism 20/closed loop 30) may be movably (i.e. pivotally or rotationally) coupled to the support surface 52/rear cover 14 by a crease, indentation, transition portion, area of thinning or the like 66 (see also FIGS. 10 and 11). As best shown in FIGS. 14 and 15 the crease 66 may have some raised stiffening ribs located thereon to limit the flexibility/increase strength of the crease 66. However, the notebook 10 need not necessarily include any crease 66 or the like. In particular, in one embodiment each support portion 62 transitions smoothly to the support surface 52/rear cover 14 such that both the support portion 62 and the support surface 52/rear cover 14 have the same thickness, and there are no notches or areas of weakness located therebetween. In this case, however, the cantilevered and/or flexible nature of each support portion 62 may allow each support portion 62 move, pivot or rotate relative to the support surface 52/rear cover 14.

Because each protrusion 22 and flange 28 is fixedly and non-removably coupled to the support surface 52/rear cover 14, each loop 30 may be fixedly and non-removably coupled to the support surface 52/rear cover 14. In addition, each loop 30 may not be slidably coupled to the support surface 52/rear cover 14 such that each loop 30 cannot spin (i.e. spin about an axis extending along the length of the support surface 52) or slide relative to the support surface 52/rear cover 14. This ensures that each loop 30 is consistently located in a known and desired position.

As best shown in FIGS. 14 and 15, the base 64 of each flange 28 may be generally flat (i.e., generally rectangular in cross section) so that the flange 28 can be securely coupled to the associated support portion 62. However, the distal end of each flange 28 (i.e., the end adjacent to the associated projection 34) may be generally cylindrical in cross section such that the projection 34 can be securely coupled thereto. Accordingly, each flange 28 may gradually transition from a generally rectangular cross section (at its base 64) to a generally circular cross section (at its distal end). The flat shape at the base 64 of each flange 28 also provides increased pivotable flexibility to allow the flange 28 and projection 34 to be manually moved by an adult or juvenile of ordinary strength into and out of contact with the associated protrusion 22.

Figure 16A:
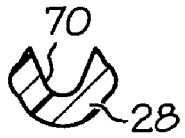
FIGS. 16A-C are various cross sections taken along the lines indicated in FIG. 15.
Figure 16B:
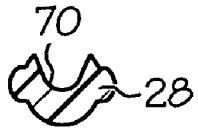
Figure 16C:
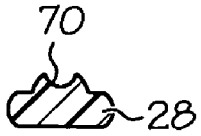
Figure 17:
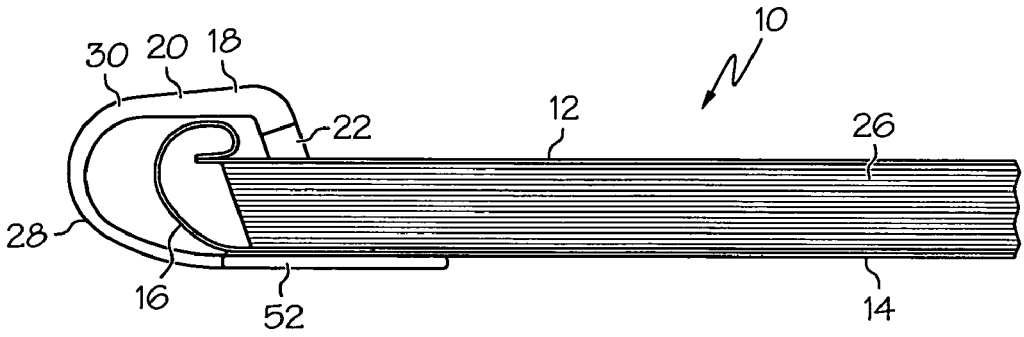
FIG. 17 is a side view of the notebook of FIG. 7.

FIGS. 16A, 16B and 16C show various cross sections along the length of a flange 28 to illustrate one embodiment of the transition of shape along the flange 28. Although the flange 28 may vary in its cross sectional shape along its length, the flange 28 may have a generally uniform volume along its entire length (i.e., each cross section may have the same surface area). The flange 28 may include a cored out area 70 to improve ease of manufacture, provide material savings, or improve structural characteristics.

In order to assemble the notebook 10 of FIGS. 1-3, the binding portion 54, rear cover 14, spine guard 16 and front cover 12 may be provided, as shown in FIG. 8. The binding portion 54 may then be coupled to the rear cover 14 by the rivets 60 and/or stitching 63. The inner edge of the spine guard 16 is then doubled over and coupled to the front cover 12, such as by stitching or the like (although, if desired, the spine guard 16 could instead be coupled to the rear cover 14 prior to attachment to the front cover 12). Carrying out these steps provides the assembly shown in FIG. 9.

The spine guard 16 may have a set of three elongated holes 72 formed therethrough with each hole 72 being located and configured to receive one of the protrusions 22 therethrough. The front cover 12 may also include a set of three notches 74 formed therethrough, with each notch 74 being aligned with an associated hole 72, and being located and configured to receive one of the protrusions 22 therethrough. The free longitudinal edge of the spine guard 16 is then coupled to the rear cover 14, such as by stitching, to thereby provide the notebook 10 shown in FIGS. 1-3. In this manner the front cover 12 and spine guard 16 are both mounted to the binding mechanisms 20 such that the front cover 12 and spine guard 16 can freely pivot about the loops 30/binding mechanisms 20, and the front cover 12 and spine guard 16 are not fixedly coupled to the rear cover 14.

In order to utilize the notebook 10, the notebook 10 of FIG. 1 is first provided. The front cover 12 is then pivoted about the loops 30/binding mechanisms 20 to its open position, as shown in FIG. 2. Each of the binding mechanisms 20 are then moved to their open positions, as shown in FIG. 3, wherein the flanges 28 are spaced apart from the associated protrusions 22. Sheet items 26, such as paper sheets, can then be located on or supported by the rear cover 14 such that a protrusion 22 passes through each of the holes 24 of the sheet items 26 (FIG. 4). For example, each of the binding mechanisms 20 may be spaced apart by about 4¼ inches on center to receive sheet items 26 or other components having corresponding holes thereon. Of course, the spacing, number and arrangement of binding mechanisms 20 can be adjusted to accommodate sheet items having differing hole configurations from that shown in FIG. 4. As noted above and shown in FIG. 4, the rear cover 14 may be sized to generally correspond to the size of the sheet items 26.

Figure 6:
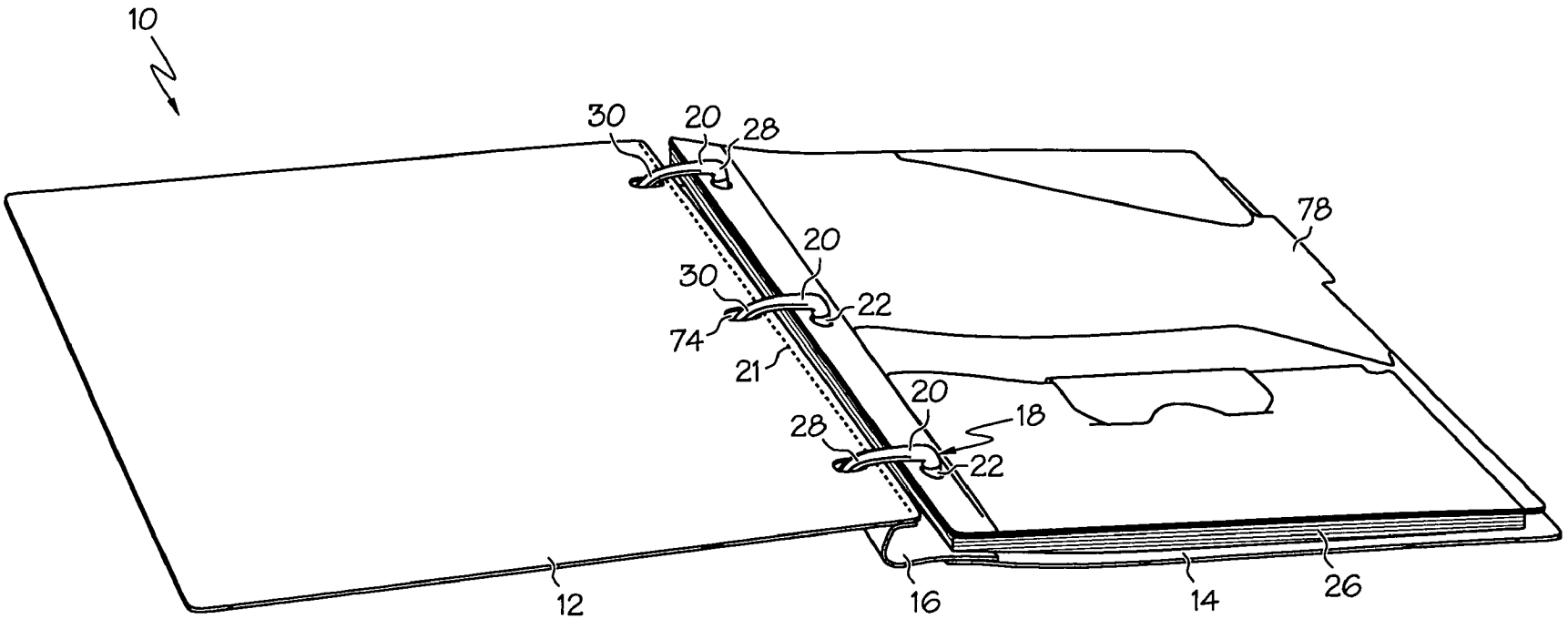
FIG. 6 is a front perspective view of the notebook of FIG. 5, with a pocket component bound therein.

In addition, besides sheets of paper, various other components such as folders, pockets, dividers, hole punches, sticker sheets, rulers or nearly any component having the appropriate hole configuration can be used as sheet items and mounted onto the protrusions 22/rear cover 14. For example, as shown in FIG. 6, a pocket component 78 having holes in a pattern matching the pattern of the binding mechanisms 20 can be bound thereto. If desired, an uppermost and/or lowermost one of the bound sheet items 26 may be a relatively stiff, rigid material, such as cardboard, plastic or the like, to provide top and bottom protective components (not shown) in place of or in addition to the covers 12, 14.

Figure 5:
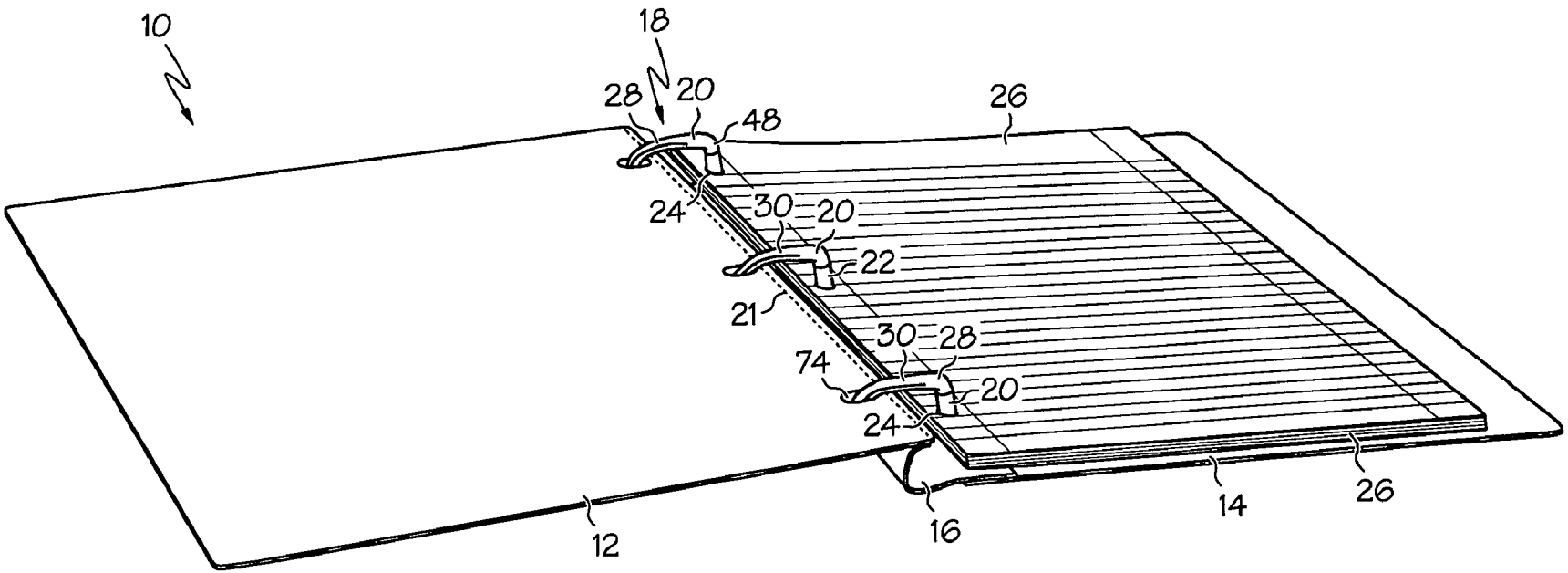
FIG. 5 is a front perspective view of the notebook of FIG. 4, with the binding mechanisms in their closed positions.
Figure 7:
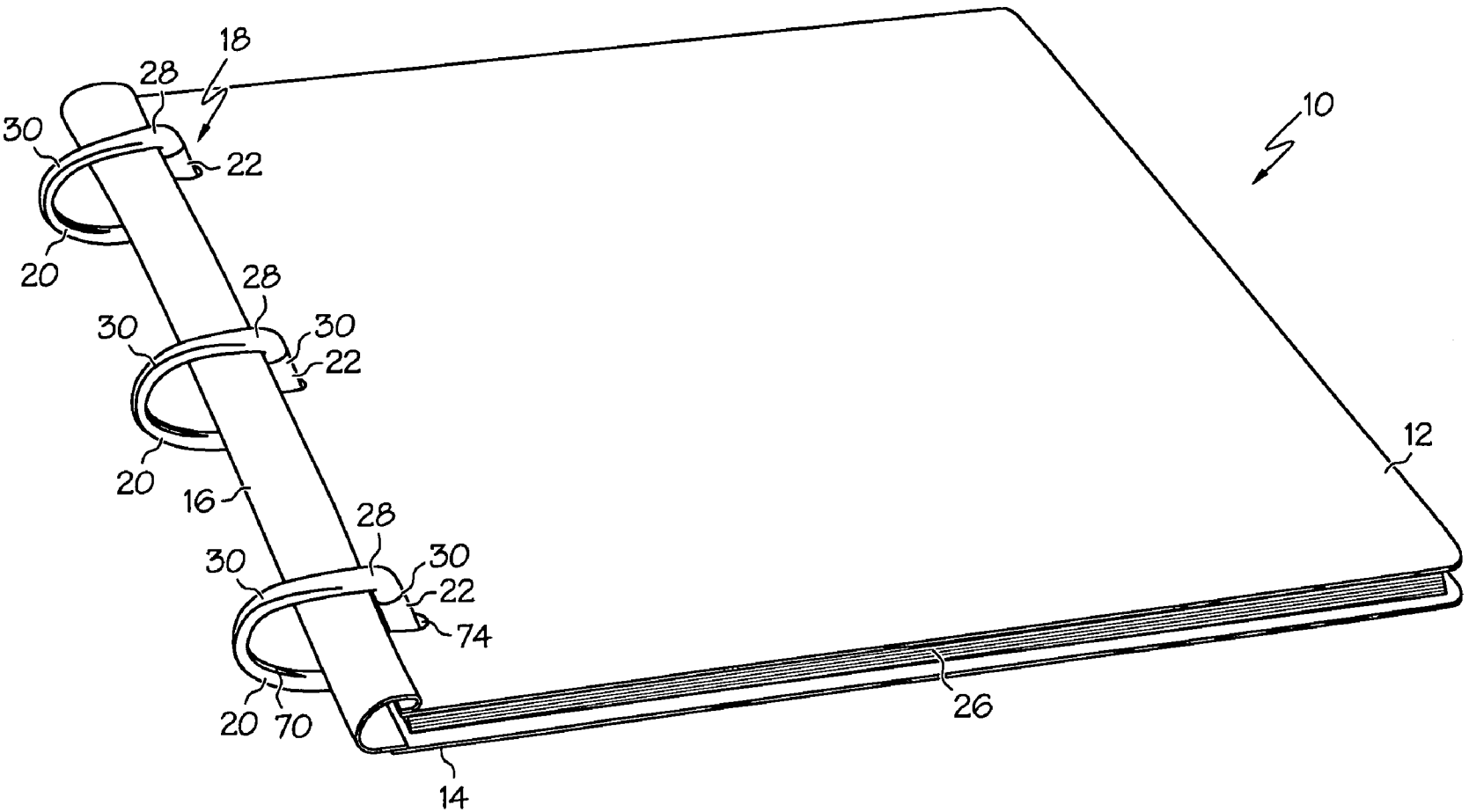
FIG. 7 is a front perspective view of the notebook of FIG. 6, with the front cover closed.

After the sheet items 26 have been mounted onto the protrusions 22/rear cover 14, the flanges 28 are moved to a closed position such that their projections 34 are received in the associated protrusions 22 and securely coupled thereto (in the manner described above) by the associated coupling assembly 36 to form the closed loops 30 (FIG. 5). In this manner, the notebook 10 of FIG. 5 has a plurality of sheet components 26 bound therein which are securely held in place by the binding mechanisms 20. The front cover 12 may be closed to thereby cover and protect the sheet components 26 bound thereto (see FIG. 7). When the notebook 10 is in the closed position the spine guard 16 helps to protect the spine (i.e., inner edges) of the sheet components 26 and the top cover 12 protects the top surface of the sheet components 26 to provide a finished and pleasing look to the notebook 10.

As shown in FIG. 10, each support portion 62 may form an angle A with the support surface 52/rear cover 14 when no sheet items are received in the notebook 10. The angle A may range between zero degrees and thirty degrees, and in one embodiment is about fifteen degrees. As described above, if desired the protrusions 22 may extend generally vertically relative to the support surface 52/rear cover 14 when no sheet items are bound therein (as shown in FIG. 10). In this case the protrusion 22 may form an acute angle of, for example, between about sixty degrees and about ninety degrees with the support portions 62. Further alternately, the angle A may be about zero degrees. In this case, the protrusion 22 may lean to the left of its position shown in FIG. 10, and may form an angle of between about zero degrees and about thirty degrees with a vertical axis. In yet another embodiment, the protrusions 22 extends generally perpendicularly from the support surface 52/rear cover 14.

Figure 12:
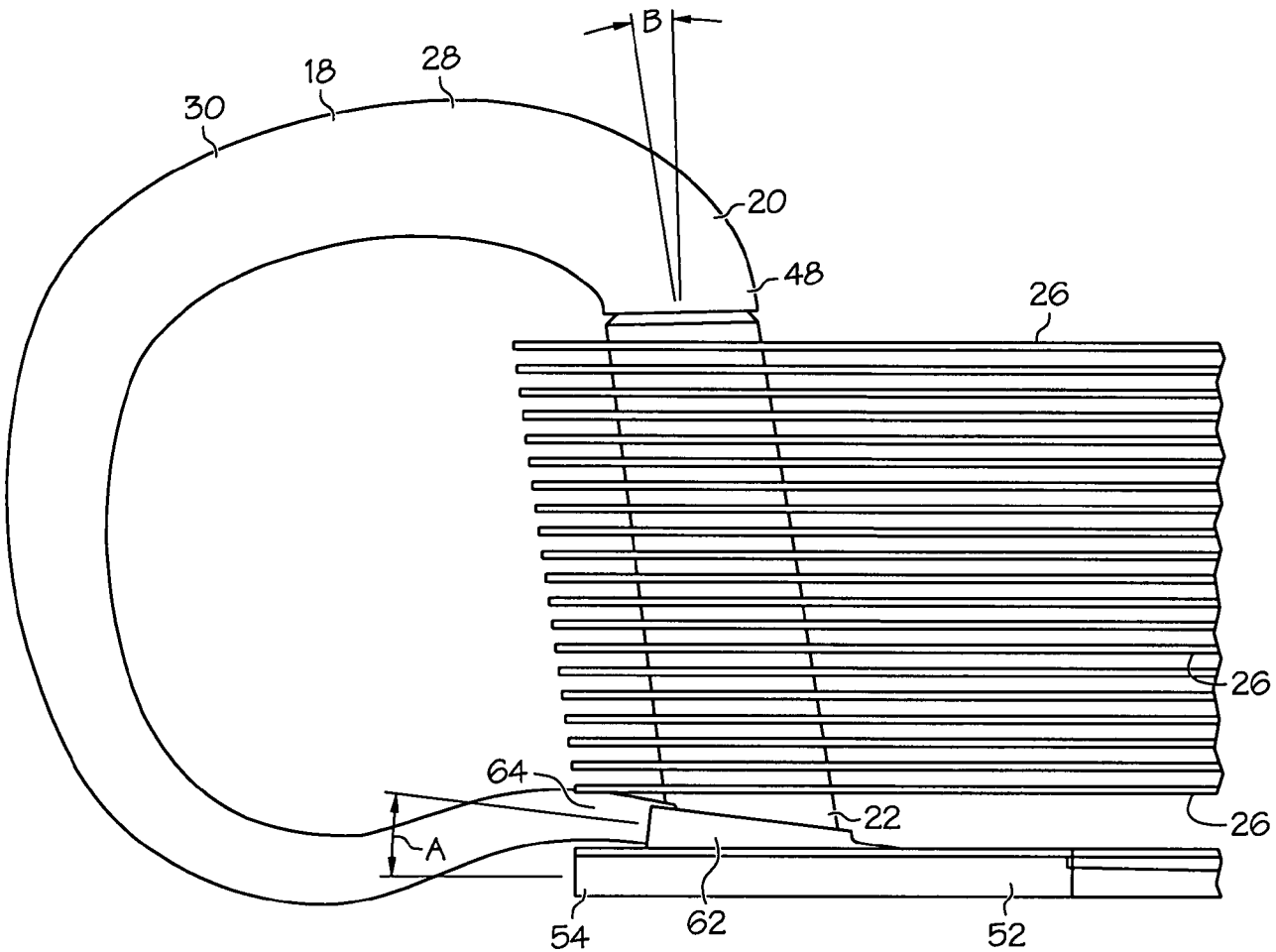
FIG. 12 is an end view of the binding mechanism of FIG. 10, with a plurality of papers bound thereto.

As shown in FIG. 12, when a plurality of sheet items 26 are received in the notebook 10, the weight of the sheet items 26 may press down on the support portions 62, thereby reducing the angle A (with respect to the angle A shown in FIG. 10) and causing the protrusions 22 to lean back and form a slight angle B with a vertical axis that is perpendicular to the support surface 52/rear cover 14. In addition, in the configuration of FIG. 12, the notebook 10 lies flat. In other words, the binding mechanisms 20 are located above, flush with or slightly below the support surface 52/rear cover 14 such that the notebook 10 can lie substantially flat on a planar surface such as a table, desktop, another notebook or binder, or the like.

Figure 13:
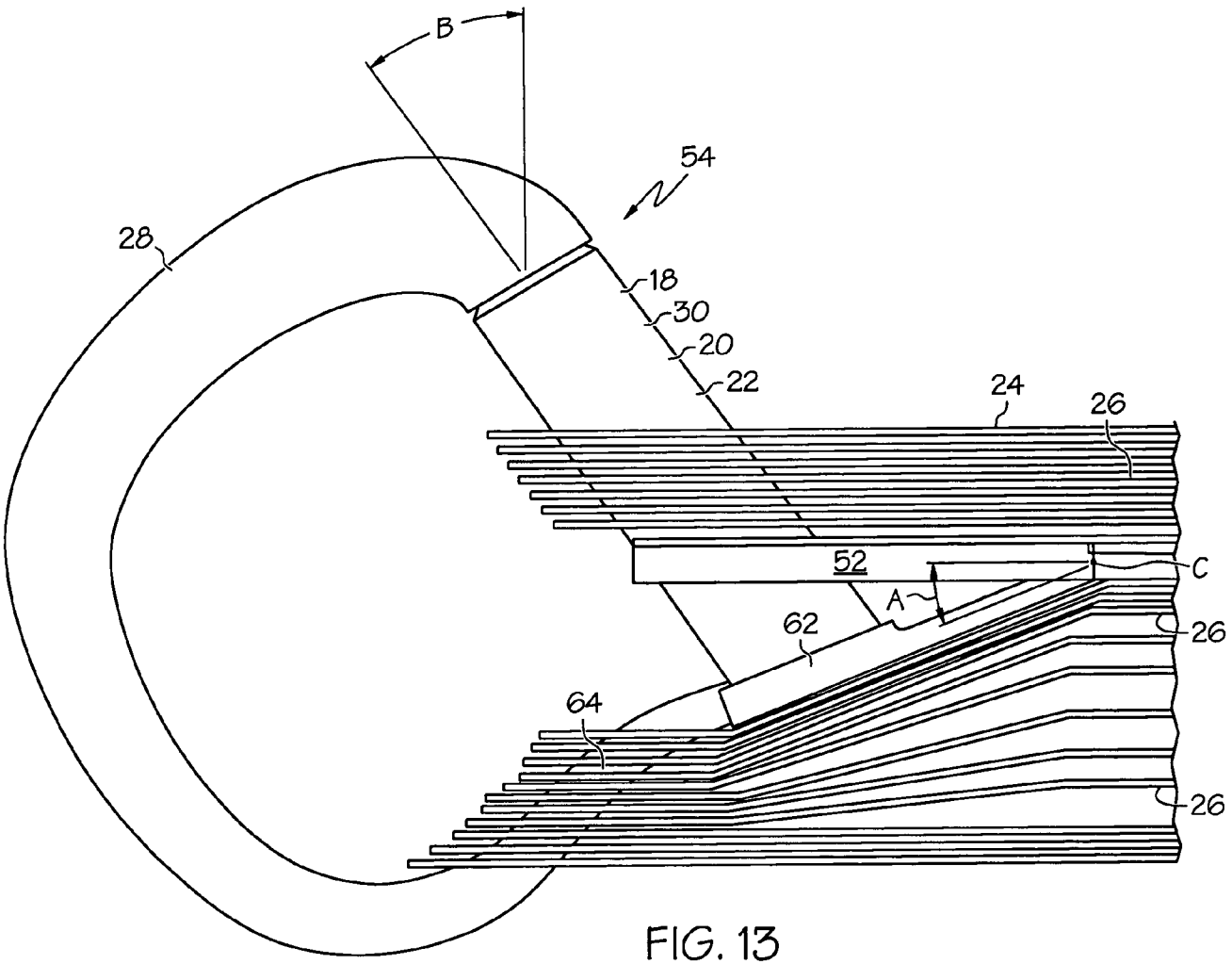
FIG. 13 is an end view of the binding mechanism of FIG. 12, with part of the plurality of papers pivoted about the binding mechanism.
Figure 18:
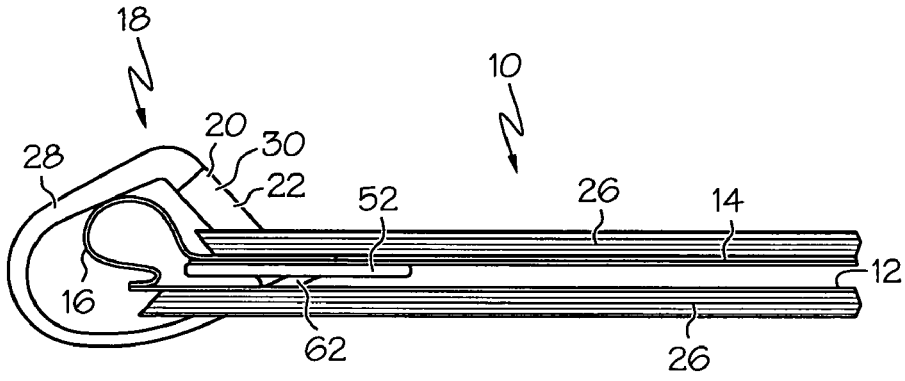
FIG. 18 is a side view of the notebook of FIG. 17, with the front cover and part of the papers pivoted about the binding mechanisms.
Figure 19:
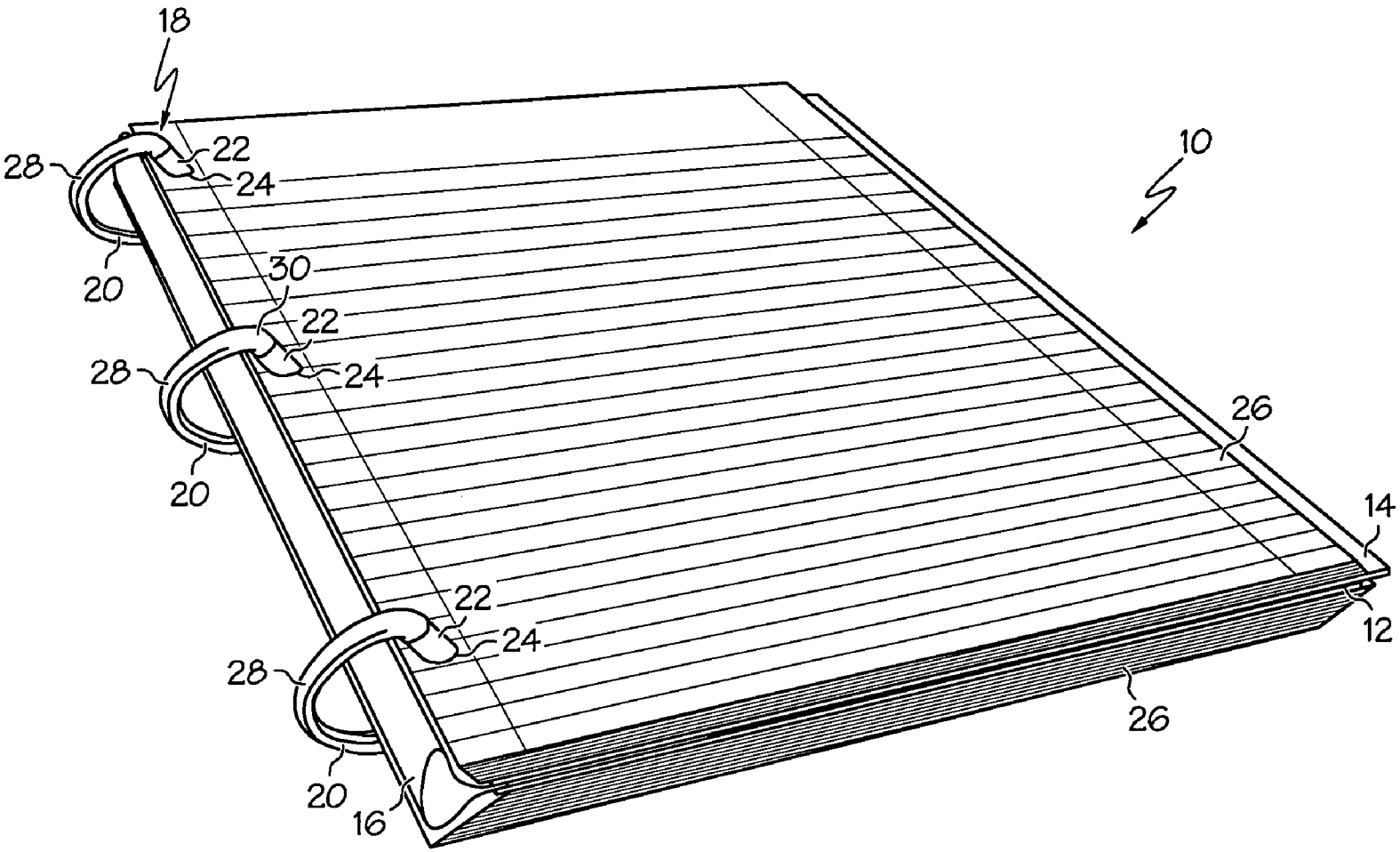
FIG. 19 is a front perspective view of the notebook of FIG. 18.

During use of the notebook 10, the user will typically desire to access sheet items 26 located in the middle of the stack of sheet items 26 for writing upon, for removal, for the addition of sheet items, etc. Accordingly, in order to access the intermediate sheet items, selected upper sheet items of the stack of sheet items 26 are lifted up and folded around the closed loops 30 of the binding mechanisms 20 until they are located below the support surface 52/rear cover 14, as shown in FIGS. 13, 18 and 19. As the pages 26 are folded in this manner, due to the positioning of the pages 26 each support portion 62 may pivot relative to the support surface 52/rear cover 14 such that at least part of the support portions 62/protrusions 22/closed loops 30 are located below the support surface 52/rear cover 14 (see FIG. 13). In this position, each protrusion 22 forms a greater angle B with the vertical axis compared to when sheet items 26 do not underlie the support surface 52/rear cover 14. In addition, the angle A formed between the support portions 26 and the support surface 54/rear cover 14 is a negative angle. As can be seen in comparing FIGS. 12 and 13, the loop 30 is pivotable about a pivot axis C that is spaced inwardly from an inner edge of the support surface 52/rear cover 14.

This pivoting nature of the binding mechanisms 20, in combination with the shape/curvature of the base portion 64 of the flanges 28, allows the folded/pivoted sheet items 26 to substantially entirely underlie the rear cover 14 to provide a compact notebook 10 in the folded position. Each sheet item 26 may be pivotable at least about 330 degrees. Each loop 30 may be pivotable about a point located on or adjacent to the loop 30 that is spaced away from an inner edge of the support surface 52/rear cover 14. The loops 30 may not be rotatable or pivotable about a center axis that extends through a center of the closed loops 30.

The pivotal nature of the binding mechanisms 20 allows the base portion 64 of the flange 28 to assume a more "vertical" position compared to when the binding mechanisms 20 are not pivoted. In addition, portions of the flange 28 are located below an upper flat surface of the support surface 52/rear cover 14. These features allow the sheet items 26 to move more to the right (with reference to FIG. 13) than would otherwise be possible so that the folded sheet items 26 more closely underlie the rear cover 14 and overlying sheet items 26. In addition, the pivoted sheet items (located below the support surface 52/rear cover 14) may be generally aligned with, and generally parallel to, the unpivoted sheet items (located above the support surface 52/rear cover 14). This allows for a more compact notebook 10 in its folded position.

Each binding mechanism 20 automatically pivots to the optimal position given the number of sheet items 26 located under the rear cover 14 to provide a flat, compact notebook 10. The manner in which the binding mechanisms 20 pivot such that they are located below the rear cover 14/support surface 52 which allows the sheet items 26 to remain generally flat and planar with minimal creasing or folding thereof. Although some of the folded sheet items 26 may have somewhat of a crease formed therein (see FIG. 13), the crease is not very sharp and forms an obtuse angle. In addition, as shown in FIGS. 18 and 19, the notebook 10 can lie substantially flat, even when sheet items 26 are folded around the binding mechanisms 20 to underlie each other or the rear cover 14.

Each protrusion 22 and/or binding mechanism 20 may be located adjacent to the outer edge of the rear cover 14 in the illustrated embodiment. For example, with reference to FIGS. 14 and 15, the support surface 52 includes the plurality of notches 61, and each support portion 62 is located in one of the notches 61. In this manner, as described above, each protrusion 22/closed loop 30 can be pivoted or moved to a position such that at least part of the protrusion 22/support portion 62/closed loop 30 is located below the rear cover 14/support surface 52 (i.e., on the opposite side of the rear cover 14/support surface 52 from which the protrusion 22 extends upwardly).

Figure 9:
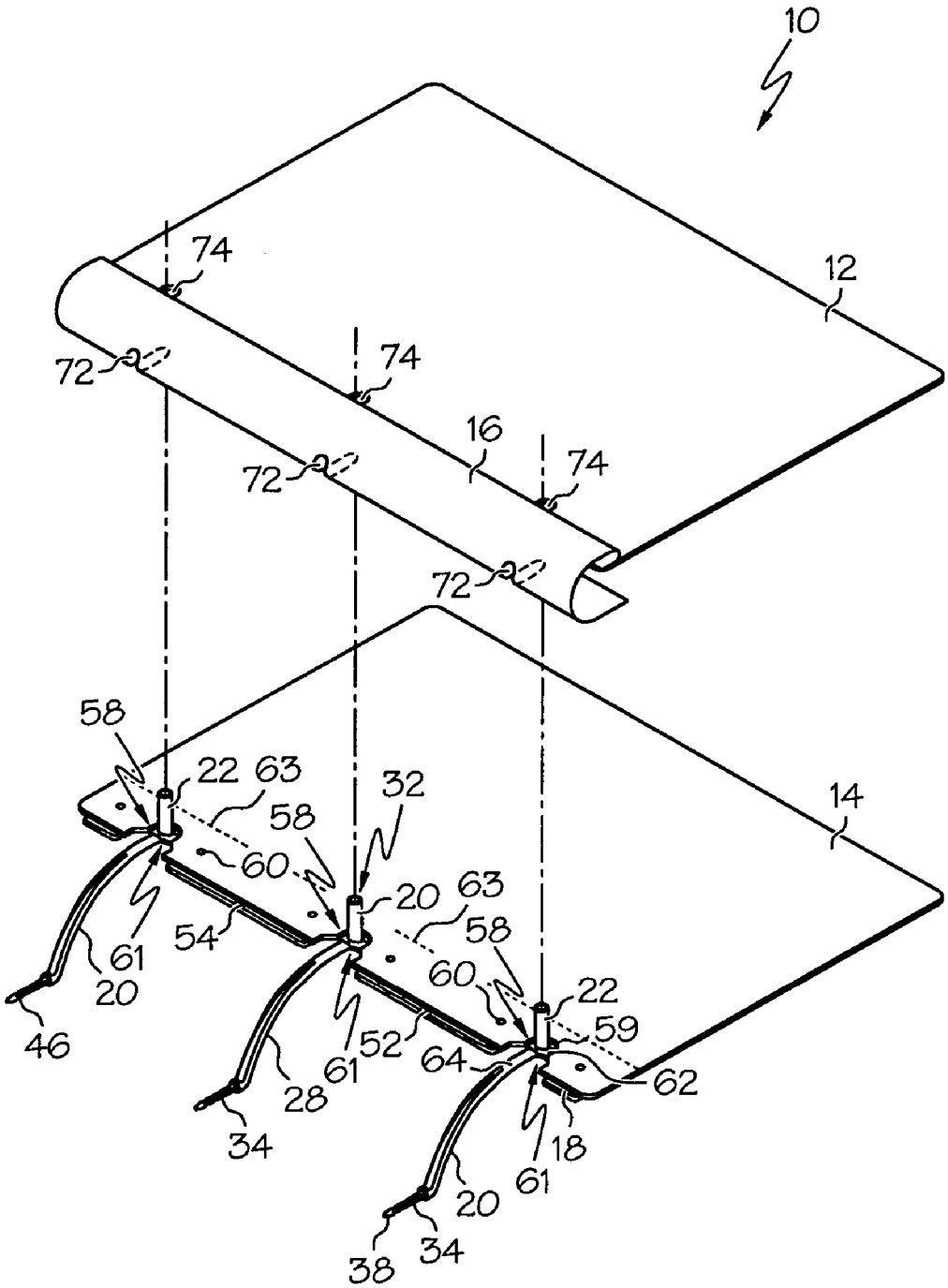
FIG. 9 is a perspective view of the notebook of FIG. 8 in a partially assembled state.

With reference to FIGS. 8 and 9, the inner surface 59 of each notch 58 of the rear cover 14 defines a stop surface which limits the pivoting motion of each binding mechanism 20 in a forward direction. In particular, if a binding mechanism 20 were attempted to be pivoted in the opposite direction to that described above (i.e., if a binding mechanism 20 of FIG. 12 were attempted to be pivoted clockwise), the lower end of the protrusion 22 would engage the stop surface 59 and limit significant pivoting motion (i.e., about 15 degrees in one case) in this direction. In the embodiment shown in FIGS. 8 and 9 each notch 58 has a generally tapered shape, with the narrowest portion of the notch 58 being configured to relatively closely receive a protrusion 22 therein. The tapered shaped of the notch 58 may help to smoothly guide the associated protrusion 22 therein (i.e. when a protrusion 22 is pivoted), and the narrowest portion of each notch 58 may help to limit lateral deflection of the associated protrusion 22. However the notches 58 can take a variety of shapes, and may, for example, be generally "U" shaped.

Figure 21:
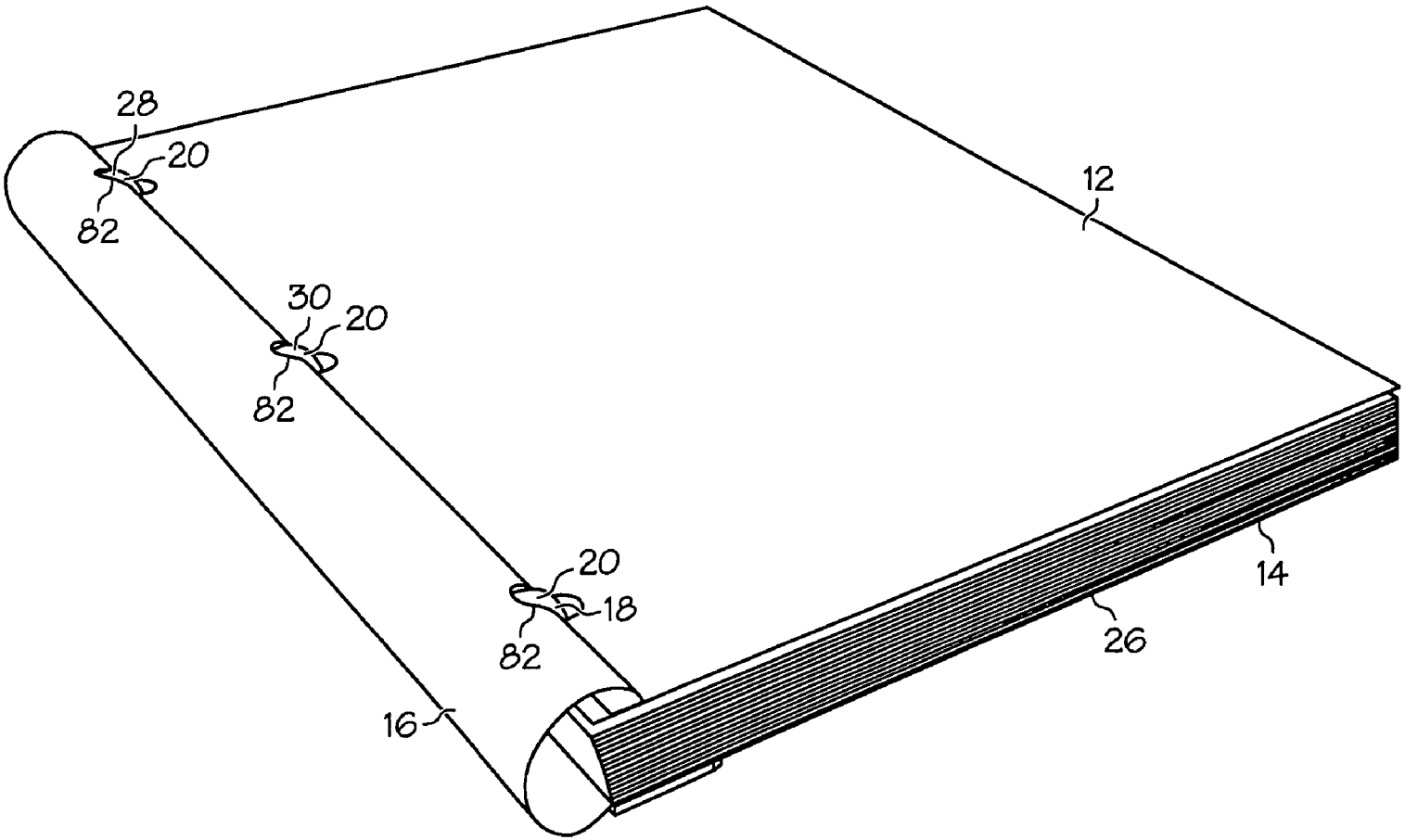
FIG. 21 is a perspective view of the notebook of FIG. 20, shown in an assembled condition.

In an alternate embodiment shown in FIGS. 20 and 21 the binding mechanisms 20 are located generally inside the spine guard 16. In this case a set of auxiliary notches 82 may be provided in the spine guard 16 to allow the upper portions of the binding mechanisms 20 to protrude therethrough. If desired, the length of the auxiliary notches 82 may be increased to allow more of the closed binding mechanisms 20 to be received therethrough. The longer auxiliary notches 82 may allow easier operation and/or access to the binding mechanism 20 and may allow the spine guard 16 to more closely conform to the contents of the notebook 10.

In the illustrated embodiment each binding mechanism 20 is independently pivotable about an axis that is generally perpendicular to a plane of that binding mechanism 20 which allows each binding mechanism 20 to independently pivot to the optimal position for that binding mechanism. However, if desired each binding mechanism 20 could be coupled together by a piece of material or the like such that each of the binding mechanisms 20 are commonly pivotable about a pivot line. Each binding mechanism 20 may be rotatable at least about 15 degrees, or at least about 30 degrees, or at least about 90 degrees, or at least about 180 degrees. Thus, for example, each binding mechanism 20 may be able to be pivoted about 180 degrees such that each binding mechanism 20 is located generally entirely below the rear cover 14/support surface 52.

The front cover 12 and spine guard 16 may not necessarily be used or included as part of the notebook 10. For example, the lower component of the embodiment of FIG. 20, wherein the front cover 12 and spine guard 16 are not utilized, can be used alone (with or without the separate binding portion 54). In addition, if desired the binding portion 54 can be used by itself, and without an attached rear cover 14. In addition, if desired an additional locking mechanism (in addition to the coupling assembly 36), can be used to mechanically lock the protrusions 22 into the cavities 32, can be used.

Having described the invention in detail and by reference to the preferred embodiments, it will be apparent that modifications and variations thereof are possible without departing from the scope of the invention.

What is claimed is:

1. A binding mechanism assembly for binding a sheet item comprising:

a backing member having an upper surface; and a binding member directly or indirectly coupled to said backing member, said binding member including a protrusion shaped and located to protrude through a hole of a sheet item to be bound thereto, said binding member further including a generally flexible polymer or plastic flange that is manually movable into engagement with said protrusion to form a generally closed loop and thereby bind said sheet item thereto, wherein said closed loop is rotatable relative to said backing member from a first position in which said closed loop is generally located above said upper surface to a second position wherein at least part of said closed loop is located below said upper surface, wherein said closed loop is rotatable relative to said backing member without requiring rotation of any part of said binding mechanism assembly other than said binding member, and wherein said closed loop is fixedly and not slidably coupled to said backing member.

2. The binding mechanism assembly of claim 1 further including two additional binding members coupled to said backing member, each additional binding member including a protrusion shaped and located to protrude through a hole of a sheet item, and a generally flexible flange that is manually moved into engagement with an associated protrusion to form a generally closed loop and thereby bind said sheet item thereto, wherein said binding member and said two additional binding members are equally spaced along said backing member.

3. The binding mechanism assembly of claim 2 wherein each flange of each of said binding members is independently movable relative to the flanges of the other binding member.

4. The binding mechanism assembly of claim 1 wherein said closed loop defines a plane, and wherein said binding member is rotatable about an axis oriented generally perpendicular to said plane of said closed loop when said closed loop moves from said first position to said second position.

5. The binding mechanism assembly of claim 4 wherein said binding member is rotatable at least about 15 degrees.

6. The binding mechanism assembly of claim 4 wherein said binding member is rotatable at least about 30 degrees.

7. The binding mechanism assembly of claim 1 wherein said binding member and said backing member are made of a single monolithic piece of material.

8. The binding mechanism assembly of claim 1 wherein said protrusion has an opening shaped to receive a distal end of said flange therein.

9. The binding mechanism assembly of claim 8 further comprising a locking arrangement configured to positively secure said flange and said protrusion to retain said distal end of said flange in said protrusion.

10. The binding mechanism assembly of claim 9 wherein said locking arrangement includes a lip located on one of said flange or said protrusion, and a recess located on the other one of said flange or said protrusion, and wherein said lip is configured to be received in said recess when said flange is inserted in said protrusion to a sufficient depth.

11. The binding mechanism assembly of claim 1 wherein said backing member has a relatively wide width and is configured to fully support 8½ inch by 11 inch paper thereon.

12. The binding mechanism assembly of claim 1 wherein said backing member has a relatively narrow width and is not configured to fully support 8½ inch by 11 inch paper or A4 size paper thereon.

13. The binding mechanism assembly of claim 12 further comprising a generally flat panel coupled to said backing member, and wherein said panel is configured to fully support 8½ inch by 11 inch paper or A4 size paper thereon.

14. The binding mechanism of claim 1 further comprising a generally flexible transition portion coupled to and positioned between said backing member and said binding member, wherein said flexible transition portion is deflected when said closed loop is moved to said second position.

15. The binding mechanism assembly of claim 14 wherein said binding member has a support portion supporting said protrusion and said flange, and wherein said transition portion is positioned between and coupled to said support portion and said backing member, wherein said support portion and said backing member each have a thickness adjacent to said transition portion, and wherein said transition portion has a thickness less than the adjacent thickness of both said support portion and said backing member.

16. The binding mechanism assembly of claim 1 wherein said backing member has a cut-out formed therein, and wherein said protrusion is located in said cut-out.

17. The binding mechanism assembly of claim 1 wherein when said closed loop is moved from said first position to said second position said closed loop is moved in a first direction, wherein the binding mechanism assembly further includes a stop surface configured to limit significant pivoting of said binding member in a second direction that is generally opposite to said first direction.

18. The binding mechanism assembly of claim 1 wherein said flange is sufficiently flexible to be manually deflected when said flange is moved into and out of contact with said protrusion.

19. The binding mechanism assembly of claim 18 wherein said flange includes a distal end and a base end, said base end being coupled to said protrusion, and wherein said flange has a generally non-uniform cross section configured such that said cross section generally has progressively more pivotable flexibility moving along a length of said flange from said distal end to said base end.

20. The binding mechanism assembly of claim 1 wherein said binding member is movable to a position wherein said flange and said protrusion are both generally entirely located below said upper surface.

21. The binding mechanism assembly of claim 1 further comprising a top cover that is bound to said binding member, said top cover being made of plastic, cardboard or paperboard.

22. The binding mechanism assembly of claim 21 further comprising a spine guard coupled to said top cover and to said backing member.

23. The binding mechanism assembly of claim 22 wherein said spine guard is a generally flexible and generally rectangular piece of material having a pair of opposed longitudinal edges, and wherein one of said longitudinal edges is coupled to said top cover and the other longitudinal edge is coupled to said backing member.

24. The binding mechanism assembly of claim 21 wherein said top cover and said backing member have about the same size in top view.

25. The binding mechanism assembly of claim 24 wherein said closed loop is directly coupled to said backing member in a non-binding manner and is bindingly coupled to said top cover.

26. The binding mechanism assembly of claim 21 wherein said binding mechanism assembly lacks a rigid spine located between and coupled to said top cover and said backing member.

27. The binding mechanism assembly of claim 1 wherein said closed loop is configured to be generally entirely located above said upper surface when no sheet items are bound thereto.

28. The binding mechanism of claim 27 wherein said binding member is configured to bind a plurality of sheet items thereto, and wherein at least part of said bound plurality of sheet items are pivotable about said closed loop to a position wherein said pivoted sheet items are located below said backing member, and wherein said closed loop is configured to be automatically moved to said second position when said pivoted sheet items are located below said backing member.

29. The binding mechanism assembly of claim 28 wherein said flange includes a generally horizontally extending base portion when all of said plurality of sheet items are located on a front side of said backing member, and wherein said generally horizontally extending base portion extends at least partially in a downward direction relative to said backing member when said pivoted sheet items are located below said backing member to thereby allow said pivoted sheet items to more fully underlie said backing member.

30. The binding mechanism of claim 1 wherein said binding member is configured to bind a plurality of sheet items thereto, and wherein at least part of said bound plurality of sheet items are pivotable about said closed loop to a position wherein said pivoted sheet items are located below said backing member and the remainder of said plurality of sheet items are located above said backing member, and wherein said plurality of sheet items located below said backing member are generally parallel with said plurality of sheet items located above said backing member.

31. The binding mechanism assembly of claim 30 further comprising said plurality of sheet items, each sheet item having a hole receiving said binding member therethrough such that said plurality of sheet items are bound together by said binding member.

32. The binding mechanism assembly of claim 1 wherein said closed loop is generally oval or rectangular in end view.

33. The binding mechanism of claim 1 wherein said closed loop is manually pivotable relative to said backing member to said second position.

34. The binding mechanism assembly of claim 1 wherein said flange is directly coupled to said protrusion.

35. The binding mechanism assembly of claim 1 further comprising a sheet item bound to said closed loop, wherein said sheet item is pivotable at least about three hundred and thirty degrees about said closed loop.

36. The binding mechanism assembly of claim 1 wherein said backing member has an inner edge extending generally parallel to a spine of said binding mechanism assembly, and wherein said closed loop is rotatable about a pivot axis relative to said backing member and wherein said pivot axis is laterally spaced away from said inner edge.

37. The binding mechanism assembly of claim 1 wherein said protrusion and said flange are made of a polymer.

38. A binding mechanism assembly for binding one or more sheet items, comprising:

a backing member having an upper surface; and a binding member directly or indirectly coupled to said backing member, said binding member including a protrusion shaped and located to protrude through a hole of one or more sheet items to be bound thereto, said binding member further including a generally flexible polymer or plastic flange that is manually movable into engagement with said protrusion to form a generally closed loop and thereby bind said sheet item thereto, wherein said closed loop is rotatable in a first direction relative to said backing member from a first position in which said closed loop is generally located above said upper surface to a second position wherein at least part of said closed loop is located below said upper surface, said closed loop also rotatable in a second direction opposite from said first direction;

wherein said binding member is movable to a position wherein said flange and said protrusion are both generally entirely located below said upper surface, wherein said closed loop is fixedly and not slidably coupled to said backing member, wherein said backing member has a cut-out formed therein and said cutout is configured to limit significant pivoting of said binding member in said second direction when said closed loop is moved in said second direction from said second position to said first position, said protrusion being located in said cut-out when said closed loop is in said first position, wherein said flange includes a generally horizontally extending base portion when all of said plurality of sheet items are located on a front side of said backing member, and wherein said generally horizontally extending base portion extends at least partially in a vertical downward direction relative to said backing member when said pivoted sheet items are located below said backing member.

* * * * *